US005202206A

United States Patent [19]

Tam

[11] Patent Number: 5,202,206

[45] Date of Patent: Apr. 13, 1993

[54] PROCESS FOR SIMULTANEOUS PRINTING OF FIXED DATA AND VARIABLE DATA

[75] Inventor: Man C. Tam, Mississauga, Canada

[73] Assignee: Xerox Corporation, Stamford, Conn.

[21] Appl. No.: 770,819

[22] Filed: Oct. 4, 1991

[51] Int. Cl.[5] ..... G03G 5/04

[52] U.S. Cl. ..... 430/41; 430/67

[58] Field of Search ..... 430/41, 67, 58, 120, 430/117

[56] References Cited

U.S. PATENT DOCUMENTS

| | | | |
|---|---|---|---|
| 3,574,614 | 4/1971 | Carreira | 96/1.4 |
| 4,124,286 | 11/1978 | Barasch | 355/3 |
| 4,167,324 | 9/1979 | Wu | 355/3 R |
| 4,536,457 | 8/1985 | Tam | 430/41 |
| 4,536,458 | 8/1985 | Ng | 430/41 |
| 4,835,570 | 5/1989 | Robson | 346/160 |
| 4,853,307 | 8/1989 | Tam et al. | 430/41 |
| 4,880,715 | 11/1989 | Tam et al. | 430/41 |
| 4,883,731 | 1/1989 | Tam et al. | 430/41 |
| 4,970,130 | 11/1990 | Tam et al. | 430/41 |

*Primary Examiner*—Marion E. McCamish
*Assistant Examiner*—Rosemary Ashton
*Attorney, Agent, or Firm*—Judith L. Byorick

[57] ABSTRACT

Disclosed is an imaging process for simultaneous printing of fixed and variable data which comprises, in the order states, (1) providing a migration imaging member comprising a substrate, a softenable layer comprising a softenable material and migration marking material contained at or near the surface of the softenable layer, and a charge transport material capable of transporting charges of one polarity; (2) uniformly charging the imaging member; (3) exposing the charged imaging member to activating radiation in an imagewise pattern corresponding to the fixed data, thereby forming an electrostatic latent image on the imaging member; (4) thereafter causing the softenable material to soften by the application of heat, thereby enabling the migration marking material exposed to radiation to migrate through the softenable material toward the substrate in an imagewise pattern corresponding to the fixed data; (5) uniformly charging the imaging member to the same polarity as the polarity of the charges that the charge transport material in the softenable layer is capable of transporting; (6) exposing the charged imaging member to activating radiation in an imagewise pattern corresponding to the variable data, thereby creating an electrostatic latent image on the imaging member corresponding to the variable data in areas of the imaging member wherein the migration marking material has not migrated; (7) uniformly charging the imaging member to the polarity opposite to the polarity of the charges that the charge transport material in the softenable layer is capable of transporting; (8) uniformly exposing the charged member to activating radiation, thereby forming an electrostatic latent image corresponding to both the fixed data and the variable data; (9) developing the electrostatic latent image; and (10) transferring the developed image to a receiver sheet.

20 Claims, 9 Drawing Sheets

PROCESS FOR SIMULTANEOUS PRINTING OF FIXED DATA AND VARIABLE DATA

BACKGROUND OF THE INVENTION

The present invention is directed to a printing process that enables simultaneous printing of fixed data (information that remains the same for every document in a series of printed documents) and variable data (information that differs from document to document in a series of printed documents). More specifically, the present invention is directed to a xeroprinting process employing a migration imaging member that enables simultaneous printing of fixed data and variable data. One embodiment of the present invention is directed to an imaging process for simultaneous printing of fixed and variable data which comprises, in the order stated, (1) providing a migration imaging member comprising a substrate, a softenable layer comprising a softenable material and migration marking material contained at or near the surface of the softenable layer, and a charge transport material capable of transporting charges of one polarity; (2) uniformly charging the imaging member; (3) exposing the charged imaging member to activating radiation in an imagewise pattern corresponding to the fixed data, thereby forming an electrostatic latent image on the imaging member; (4) thereafter causing the softenable material to soften by the application of heat, thereby enabling the migration marking material exposed to radiation to migrate through the softenable material toward the substrate in an imagewise pattern corresponding to the fixed data; (5) uniformly charging the imaging member to the same polarity as the polarity of the charges that the charge transport material in the softenable layer is capable of transporting; (6) exposing the charged imaging member to activating radiation in an imagewise pattern corresponding to the variable data, thereby creating an electrostatic latent image on the imaging member corresponding to the variable data in areas of the imaging member wherein the migration marking material has not migrated; (7) uniformly charging the imaging member to the polarity opposite to the polarity of the charges that the charge transport material in the softenable layer is capable of transporting; (8) uniformly exposing the charged member to activating radiation, thereby forming an electrostatic latent image corresponding to both the fixed data and the variable data; (9) developing the electrostatic latent image; and (10) transferring the developed image to a receiver sheet.

Simultaneous printing of fixed data and variable data is often a requirement in many printing applications. Examples of documents containing both fixed and variable data include personalized direct mailing documents, business forms, personalized checks, bank notes, and the like. The documents frequently are characterized by two features. First, the fixed data frequently consist of complicated high resolution images, such as pictures on a bank note, while the variable data typically consist of low resolution text, such as the serial number on a bank note. Second, the amount of variable data in the document typically is much smaller than the amount of fixed data in the document.

In the art of printing/duplicating, various techniques have been developed for preparing masters for subsequent use in printing processes. For example, lithographic or offset printing is a well known and established printing process. In general, lithography is a method of printing from a printing plate which depends upon different properties of the imaged and non-imaged areas for printability. In conventional lithography, a lithographic intermediate is first prepared on silver halide film from the original; the printing plate is then contact exposed by intense UV light through the intermediate. UV exposure causes the exposed area of the printing plate to become hydrophobic; the non-exposed area is washed away by chemical treatment and becomes hydrophilic. Printing ink is then applied to the printing plate and the ink image is transferred to an offset roller where the actual printing takes place. Although lithographic printing provides high quality prints and high printing speed, the processes require the use of expensive intermediate films and printing plates. Additionally, considerable cost and time are consumed in their preparation, often requiring highly skilled labor and strict control measures. A further disadvantage is the time consuming process and difficulty in setting up the printing press to achieve the proper water to ink balance required to produce the desired results during the printing process. This results in further increased cost and delay time in obtaining the first acceptable print.

The above mentioned problems become especially severe in the manufacture of high quality color prints when several color separation images must be superimposed on the same receiving medium. Because of the high cost and complexities associated with the preparations of expensive printing plates and press runs, color proofing is employed to form representative interim prints (called proofs) from color separation components to allow the end user to determine whether the finished prints faithfully reproduce the desired results. As is often the case, the separation components can require repeated alteration to satisfy the end user. Only when the end user is satisfied with the results, a printing plate associated with each separation component is prepared and ultimately employed in the press run. An example of a color proofing system is the CROMALIN system, introduced by E. I. duPont de Nemours & Company in 1972 and widely used in the printing industry, and consisting of a light sensitive tacky photopolymer layer laminated to paper. The photopolymer layer is contact exposed through a color separation component under a UV source. The exposed areas polymerize and lose their tackiness, while the non-exposed areas remain tacky. Toners are then applied and adhere to the tacky areas. Since very different processes are employed in proofing and press runs, the proofs at best can only simulate the press sheets. Additionally, preparation of the color proofs is a time consuming process, and can require about 30 minutes per proof.

Xerographic printing is another well known printing technique. In conventional xerographic printing, an electrostatic image is first produced, either by lens coupled exposure to visible light or by laser scanning, on a conventional photoreceptor; the electrostatic image is then toned, followed by transfer of the toner image to a receiving medium. While this printing process offers the advantages of ease of operation and printing stability and requires less skilled involvement and labor cost, the combined requirements of high quality and high printing speed needed in commercial printing cannot be met easily at reasonable cost because, to provide high quality and avoid certain artifacts, very high-picture-element density is also required. If a new image were to be written, for example, on the photoreceptor for each print, these requirements for high speed and high density would imply electronic bandwidths and (if laser scanning were used) modulation rates and polygon rotation speeds which are very unlikely to be available at reasonable cost in the foreseeable future. In addition, the difficulties associated with conventional xerographic duplicating and printing include the necessity to repeat the imagewise exposure step continually at high speed.

Xeroprinting is another xerographic printing method. Conceptually, xeroprinting overcomes the above problems in a very simple way. Xeroprinting is an electrostatic printing process for printing multiple copies from a master plate or cylinder. The master plate can comprise a metal sheet upon which is imprinted an image in the form of a thin electrically insulating coating. The master plate can be made by photomechanical methods or by xerographic techniques. From the original, a single xeroprinting "master" can, for example, first be made slowly in, for example, 30 to 60 seconds. This imaged material is typically an electrical conductor with an imagewise pattern of insulating areas made by photomechanical or xerographic techniques; it has different charge acceptance in the imaged and non-imaged areas. Thus, generally, the imaging surface of the master plate comprises an electrically insulating pattern corresponding to the desired image shape and electrically conductive areas corresponding to the background. The xeroprinting master is then uniformly charged; the charge remains trapped only on the insulating areas, and this electrostatic image can then be toned. After toner transfer to paper and possibly cleaning, the charge-tone-transfer-clean process is repeated at high speed. In principle, then, it is possible with a xeroprinting process to retain much of the simplicity, stability and quality of the xerographic process without the need for repeated imagewise exposure. As an additional bonus, it may not be necessary to employ a cleaning step, since the same area is repeatedly toned. Moreover, conventional toners can be used, avoiding the problem of lack of color saturation which is encountered with comparable schemes employing magnetography. High contrast potential and high resolution of the electrostatic latent image are important characteristics that determine print qualities of documents prepared by xeroprinting. However, these prior art xeroprinting techniques can produce prints of inferior quality because an insulating pattern on a metal conductor cannot be fully and uniformly charged near its boundaries. As contrast potential builds up along the boundaries of the insulating pattern, fringing electric fields from the insulating image areas repel incoming ions from the charging device, which is usually a corona charging device, to the adjacent electrically conductive background areas. This results not only in low contrast potential but also in poor print resolution. Additionally, some xeroprinting processes require numerous processing steps and complex equipment to prepare the master and/or final xeroprinted product. Some xeroprinting techniques also require messy photochemical processing and removal of materials in either the image or non-image areas of the master.

In U.S. Pat. No. 3,574,614 (Carreira), a xeroprinting process is disclosed in which the xeroprinting master is formed by applying an electric field to a layer of photoelectrophoretic imaging suspension between a blocking electrode and an injecting electrode, one of which is transparent, the suspension comprising a plurality of photoelectrophoretic particles in an insulating carrier liquid, imagewise exposing the suspension to electromagnetic radiation through the transparent electrode to form complementary images on the surfaces of the electrodes (the light exposed particles migrating from the injecting electrode to the blocking electrode), transferring one of the images to a conductive substrate, uniformly that the binder thickness both within the image formed and the non-image that the binder thickness both within the image formed and the non-image areas ranges from 1 to 20 microns. The xeroprinting process consists of applying a uniform charge to the surface of the image bearing substrate in the presence of electromagnetic radiation to form an electrostatic residual charge pattern corresponding to the non-image areas (areas void of photoelectrophoretic particles), developing the residual charge pattern, transferring the developer from the residual charge pattern to a copy sheet, and repeating the charging, developing and transferring steps. Alternatively, the insulating binder can be intimately blended with the dispersion of the photoelectrophoretic particles prior to insertion of the liquid mixture between the electrodes. The areas from which photoelectrophoretic particles have migrated become insulating and capable of supporting an electrostatic charge. A major problem, however, is that insulating images supported directly on a conducting substrate cannot be charged close to the edges, because fringe fields drive incoming ions to the grounded substrate. Another disadvantage of these processes is that they require the use of a liquid photoelectrophoretic imaging suspension to prepare the master. Additionally, the master making processes are extremely complicated, entailing the removal of one of the electrodes, transfer of one of the complementary images to a conductive substrate, and application of an organic insulating binder to the conductive substrate. Such complicated master making processes are inconvenient to the user and can adversely affect the print quality. They also require additional time to dry the image prior to use as a xeroprinting master.

Unlike the liquid photoelectrophoretic imaging suspension system described in U.S. Pat. No. 3,574,614, solid imaging members have been prepared for dry migration systems. Dry migration imaging members are well known, and are described in detail in, for example, U.S. Pat. No. 3,975,195 (Goffe), U.S. Pat. No. 3,909,262 (Goffe et al.), U.S. Pat. No. 4,536,457 (Tam), U.S. Pat. No. 4,536,458 (Ng), U.S. Pat. No. 4,013,462 (Goffe et al.), and "Migration Imaging Mechanisms, Exploitation, and Future Prospects of Unique Photographic Technologies, XDM and AMEN", P. S. Vincett, G. J. Kovacs, M. C. Tam, A. L. Pundsack, and P. H. Soden, *Journal of Imaging Science* 30 (4) July/August, pp. 183–191 (1986), the disclosures of each of which are totally incorporated herein by reference Migration imaging members containing charge transport materials in the softenable layer are also known, and are disclosed, for example, in U.S. Pat. Nos. 4,536,457 (Tam) and 4,536,458 (Ng). In a typical embodiment of these migration imaging systems, a migration imaging member comprising a substrate, a layer of softenable material, and photosensitive marking material is imaged by first forming a latent image by electrically charging the member and exposing the charged member to a pattern of activating electromagnetic radiation such as light. Where the photosensitive marking material is originally in the form of a fracturable layer contiguous with the upper surface of the softenable layer, the marking particles in the exposed area of the member migrate in depth toward the substrate when the member is developed by softening the softenable layer.

The expression "softenable" as used herein is intended to mean any material which can be rendered more permeable, thereby enabling particles to migrate through its bulk. Conventionally, changing the permeability of such material or reducing its resistance to migration of migration marking material is accomplished by dissolving, swelling, melting, or softening, by techniques, for example, such as contacting with heat, vapors, partial solvents, solvent vapors, solvents, and combinations thereof, or by otherwise reducing the viscosity of the softenable material by any suitable means.

The expression "fracturable" layer or material as used herein means any layer or material which is capable of breaking up during development, thereby permitting portions of the layer to migrate toward the substrate or to be otherwise removed. The fracturable layer is preferably particulate in the various embodiments of the migration imaging members. Such fracturable layers of marking material are typically contiguous to the surface of the softenable layer spaced apart from the substrate, and such fracturable layers can be substantially or wholly embedded in the softenable layer in various embodiments of the imaging members.

The expression "contiguous" as used herein is intended to mean in actual contact, touching, also, near, though not in contact, and adjoining, and is intended to describe generically the relationship of the fracturable layer of marking material in the softenable layer with the surface of the softenable layer spaced apart from the substrate.

The expression "optically sign-retained" as used herein is intended to mean that the dark (higher optical density) and light (lower optical density) areas of the visible image formed on the migration imaging member correspond to the dark and light areas of the illuminating electromagnetic radiation pattern.

The expression "optically sign-reversed" as used herein is intended to mean that the dark areas of the image formed on the migration imaging member correspond to the light areas of the illuminating electromagnetic radiation pattern and the light areas of the image formed on the migration imaging member correspond to the dark areas of the illuminating electromagnetic radiation pattern.

The expression "optical contrast density" as used herein is intended to mean the difference between maximum optical density ($D_{max}$) and minimum optical density ($D_{min}$) of an image. Optical density is measured for the purpose of this invention by diffuse densitometers with a blue Wratten No. 94 filter. The expression "optical density" as used herein is intended to mean "transmission optical density" and is represented by the formula:

$$D=\log_{10}[I_o/I]$$

where I is the transmitted light intensity and $I_o$ is the incident light intensity. For the purpose of this invention, all values of transmission optical density given in this invention include the substrate density of about 0.2 which is the typical density of a metallized polyester substrate.

There are various other systems for forming such images, wherein non-photosensitive or inert marking materials are arranged in the aforementioned fracturable layers, or dispersed throughout the softenable layer, as described in the aforementioned patents, which also discloses a variety of methods which can be used to form latent images upon migration imaging members.

Various means for developing the latent images can be used for migration imaging systems. These development methods include solvent wash away, solvent vapor softening, heat softening, and combinations of these methods, as well as any other method which changes the resistance of the softenable material to the migration of particulate marking material through the softenable layer to allow imagewise migration of the particles in depth toward the substrate. In the solvent wash away or meniscus development method, the migration marking material in the light struck region migrates toward the substrate through the softenable layer, which is softened and dissolved, and repacks into a more or less monolayer configuration. In migration imaging films supported by transparent substrates alone, this region exhibits a maximum optical density which can be as high as the initial optical density of the unprocessed film. On the other hand, the migration marking material in the unexposed region is substantially washed away and this region exhibits a minimum optical density which is essentially the optical density of the substrate alone. Therefore, the image sense of the developed image is optically sign-reversed. Various methods and materials and combinations thereof have previously been used to fix such unfixed migration images. In the heat or vapor softening developing modes, the migration marking material in the light struck region disperses in the depth of the softenable layer after development and this region exhibits $D_{min}$ which is typically in the range of 0.6 to 0.7. This relatively high $D_{min}$ is a direct consequence of the depthwise dispersion of the otherwise unchanged migration marking material. On the other hand, the migration marking material in the unexposed region does not migrate and substantially remains in the original configuration, i.e. a monolayer. In migration imaging films supported by transparent substrates, this region exhibits a maximum optical density ($D_{max}$) of about 1.8 to 1.9. Therefore, the image sense of the heat or vapor developed images is optically sign-retained.

Techniques have been devised to permit optically sign-reversed imaging with vapor development, but these techniques are generally complex and require critically controlled processing conditions. An example of such techniques can be found in U.S. Pat. No. 3,795,512, the disclosure of which is totally incorporated herein by reference.

For many imaging applications, it is desirable to produce negative images from a positive original or positive images from a negative original (optically sign-reversing imaging), preferably with low minimum optical density. Although the meniscus or solvent wash away development method produces optically sign-reversed images with low minimum optical density, it entails removal of materials from the migration imaging member, leaving the migration image largely or totally unprotected from abrasion. Although various methods and materials have previously been used to overcoat such unfixed migration images, the post-development overcoating step can be impractically costly and inconvenient for the end users. Additionally, disposal of the effluents washed from the migration imaging member during development can also be very costly.

The background portions of an imaged member can sometimes be transparentized by means of an agglomeration and coalescence effect. In this system, an imaging member comprising a softenable layer containing a fracturable layer of electrically photosensitive migration marking material is imaged in one process mode by electrostatically charging the member, exposing the member to an imagewise pattern of activating electromagnetic radiation, and softening the softenable layer by exposure for a few seconds to a solvent vapor thereby causing a selective migration in depth of the migration material in the softenable layer in the areas which were previously exposed to the activating radiation. The vapor developed image is then subjected to a heating step. Since the exposed particles gain a substantial net charge (typically 85 to 90 percent of the deposited surface charge) as a result of light exposure, they migrate substantially in depth in the softenable layer towards the substrate when exposed to a solvent vapor, thus causing a drastic reduction in optical density. The optical density in this region is typically in the region of 0.7 to 0.9 (including the substrate density of about 0.2) after vapor exposure, compared with an initial value of 1.8 to 1.9 (including the substrate density of about 0.2). In the unexposed region, the surface charge becomes discharged due to vapor exposure. The subsequent heating step causes the unmigrated, uncharged migration material in unexposed areas to agglomerate or flocculate, often accompanied by coalescence of the marking material particles, thereby resulting in a migration image of very low minimum optical density (in the unexposed areas) in the 0.25 to 0.35 range. Thus, the contrast density of the final image is typically in the range of 0.35 to 0.65. Alternatively, the migration image can be formed by heat followed by exposure to solvent vapors and a second heating step which also results in a migration image with very low minimum optical density. In this imaging system as well as in the previously described heat or vapor development techniques, the softenable layer remains substantially intact after development, with the image being self-fixed because the marking material particles are trapped within the softenable layer.

The word "agglomeration" as used herein is defined as the coming together and adhering of previously substantially separate particles, without the loss of identity of the particles.

The word "coalescence" as used herein is defined as the fusing together of such particles into larger units, usually accompanied by a change of shape of the coalesced particles towards a shape of lower energy, such as a sphere.

Generally, the softenable layer of migration imaging members is characterized by sensitivity to abrasion and foreign contaminants. Since a fracturable layer is located at or close to the surface of the softenable layer, abrasion can readily remove some of the fracturable layer during either manufacturing or use of the imaging member and adversely affect the final image. Foreign contamination such as fingerprints can also cause defects to appear in any final image. Moreover, the softenable layer tends to cause blocking of migration imaging members when multiple members are stacked or when the migration imaging material is wound into rolls for storage or transportation. Blocking is the adhesion of adjacent objects to each other. Blocking usually results in damage to the objects when they are separated.

The sensitivity to abrasion and foreign contaminants can be reduced by forming an overcoating such as the overcoatings described in U.S. Pat. No. 3,909,262, the disclosure of which is totally incorporated herein by reference. However, because the migration imaging mechanisms for each development method are different and because they depend critically on the electrical properties of the surface of the softenable layer and on the complex interplay of the various electrical processes involving charge injection from the surface, charge transport through the softenable layer, charge capture by the photosensitive particles and charge ejection from the photosensitive particles, and the like, application of an overcoat to the softenable layer can cause changes in the delicate balance of these processes and result in degraded photographic characteristics compared with the non-overcoated migration imaging member. Notably, the photographic contrast density can degraded. Recently, improvements in migration imaging members and processes for forming images on these migration imaging members have been achieved. These improved migration imaging members and processes are described in U.S. Pat. No. 4,536,458 (Ng) and U.S. Pat. No. 4,536,457 (Tam).

U.S. Pat. No. 3,574,614 (Carreira) discloses a process in which a layer of photoelectrophoretic imaging suspension is subjected to an applied electric field between a blocking electrode and an injecting electrode, one of which is transparent, the suspension comprising a plurality of photoelectrophoretic particles in an insulating carrier liquid, imagewise exposing the suspension to electromagnetic radiation through the transparent electrode to form complementary images on the surfaces of the electrodes (the light exposed particles migrating from the injecting electrode to the blocking electrode), transferring one of the images to a conductive substrate, uniformly applying to the image bearing substrate an organic insulating binder such that the binder thickness both within the image formed and the non-image areas ranges from 1 to 20 micrometers, applying a uniform charge to the surface of the image bearing substrate in the presence of electromagnetic radiation to form an electrostatic residual charge pattern corresponding to the non-image areas (areas void of photoelectrophoretic particles), developing the residual charge pattern, transferring the developer from the residual charge pattern to a copy sheet and repeating the charging, developing and transferring steps. Alternatively, the insulating binder can be intimately blended with the dispersion of the photoelectrophoretic particles prior to insertion of the liquid mixture between the electrodes. The areas from which photoelectrophoretic particles have migrated become insulating and capable of supporting an electrostatic charge.

U.S. Pat. No. 4,536,458 (Ng) discloses a migration imaging member comprising a substrate and an electrically insulating softenable layer on the substrate, the softenable layer comprising migration marking material located at least at or near the surface of the softenable layer spaced from the substrate, and a charge transport molecule. The migration imaging member is electrostatically charged, exposed to activating radiation in an imagewise pattern, and developed by decreasing the resistance to migration, by exposure either to solvent vapor or heat, of marking material in depth in the softenable layer at least sufficient to allow migration of marking material whereby marking material migrates toward the substrate in image configuration. The preferred thickness of the softenable layer is about 0.7 to 2.5 micrometers, although thinner and thicker layers can also be utilized.

U.S. Pat. No. 4,536,457 (Tam) discloses a process in which a migration imaging member comprising a substrate and an electrically insulating softenable layer on the substrate, the softenable layer comprising migration marking material located at least at or near the surface of the softenable layer spaced from the substrate, and a charge transport molecule (e.g. the imaging member described in U.S. Pat. No. 4,536,458) is uniformly charged and exposed to activating radiation in an imagewise pattern. The resistance to migration of marking material in the softenable layer is thereafter decreased sufficiently by the application of solvent vapor to allow the light exposed particles to retain a slight net charge to prevent agglomeration and coalescence and to allow slight migration in depth of marking material towards the substrate in image configuration, and the resistance to migration of marking material in the softenable layer is further decreased sufficiently by heating to allow non-exposed marking material to agglomerate and coalesce. The preferred thickness is about 0.5 to 2.5 micrometers, although thinner and thicker layers can be utilized.

U.S. Pat. No. 4,880,715 (Tam et al.), the disclosure of which is totally incorporated by reference, discloses a xeroprinting process wherein the xeroprinting master is a developed migration imaging member wherein a charge transport material is present in the softenable layer and non-exposed marking material in the softenable layer is caused to agglomerate and coalesce. According to the teachings of this patent, the xeroprinting process entails uniformly charging the master to a polarity the same as the polarity of charges which the charge transport material is capable of transporting, followed by flood exposure of the master to form a latent image, development of the latent image with a toner, and transfer of the developed image to a receiving member. The contrast voltage of the electrostatic latent image obtainable from this process generally initially increases with increasing flood exposure light intensity, typically reaches a maximum value of about 60 percent of the initially applied voltage and then decreases with further increase in flood exposure light intensity. The light intensity for the flood exposure step thus generally must be well controlled to maximize the contrast potential.

U.S. Pat. No. 4,883,731 (Tam et al.), the disclosure of which is totally incorporated herein by reference, discloses an imaging system in which an imaging member comprising a substrate and an electrically insulating softenable layer on the substrate, the softenable layer comprising migration marking material locked at least at or near the surface of the softenable layer spaced from the substrate, and a charge transport material in the softenable layer is imaged by electrostatically charging the member, exposing the member to activating radiation in an imagewise pattern, and decreasing the resistance to migration of marking material in the softenable layer sufficiently to allow the migration marking material struck by activating radiation to migrate substantially in depth towards the substrate in image configuration. The imaged member can be used as a xeroprinting master in a xeroprinting process comprising uniformly charging the master to a polarity the same as the polarity of charges which the charge transport material is capable of transporting, uniformly exposing the charged master to activating illumination to form an electrostatic latent image, developing the latent image to form a toner image, and transferring the toner image to a receiving member. A charge transport spacing layer comprising a film forming binder and a charge transport compound may be employed between the substrate and the softenable layer to increase the contrast potential associated with the surface changes of the latent image. The contrast voltage of the electrostatic latent image obtainable from this process generally initially increases with increasing flood exposure light intensity, reaches a maximum value of about 50 percent of the initially applied voltage and then decreases with further increase in flood exposure light intensity. The light intensity for the flood exposure step thus generally must be well controlled to maximize the contrast potential.

U.S. Pat. No. 4,853,307 (Tam et al.), the disclosure of which is totally incorporated herein by reference, discloses a migration imaging member containing a copolymer of styrene and ethyl acrylate in at least one layer adjacent to the substrate. When developed, the imaging member can be used as a xeroprinting master. According to the teachings of this patent, the xeroprinting process entails uniformly charging the master to a polarity the same as the polarity of charges which the charge transport material is capable of transporting, followed by flood exposure of the master to form a latent image, development of the latent image with a toner, and transfer of the developed image to a receiving member.

U.S. Pat. No. 4,970,130 (Tam et al.), the disclosure of which is totally incorporated herein by reference, discloses a xeroprinting process which comprises (1) providing a xeroprinting master comprising (a) a substrate and (b) a softenable layer comprising a softenable material, a charge transport material capable of transporting charges of one polarity and migration marking material situated contiguous to the surface of the softenable layer spaced from the substrate, wherein a portion of the migration marking material has migrated through the softenable layer toward the substrate in imagewise fashion; (2) uniformly charging the xeroprinting master to a polarity opposite to the polarity of the charges that the charge transport material in the softenable layer is capable of transporting; (3) uniformly exposing the charged master to activating radiation, thereby discharging those areas of the master wherein the migration marking material has migrated toward the substrate and forming an electrostatic latent image; (4) developing the electrostatic latent image; and (5) transferring the developed image to a receiver sheet. The process results in greatly enhanced contrast potentials or contrast voltages between the charged and uncharged areas of the master subsequent to exposure to activating radiation, and the charged master can be developed with either liquid developers or dry developers. The contrast voltage of the electrostatic latent image obtainable from this process generally initially increases with increasing flood exposure light intensity, typically reaches a plateau value of about 90 percent of the initially applied voltage even with further increase in flood exposure light intensity.

While these known imaging members and printing processes are suitable for printing fixed data, a need remains for simultaneous printing of fixed data with variable data.

One prior art technique for printing fixed data and variable data is to print the fixed data first (typically consisting of high resolution images) using an offset press and subsequently to print the variable data (typically consisting of simple low resolution images) with a xerographic laser printer. Because offset printing is a time-consuming and expensive process, it becomes necessary to produce a large quantity of prints of fixed data only (for example, pre-printed business forms) in one printing run to reduce the cost; the variable data are printed later as needed in a xerographic laser printer. This process results in increased inventory cost and waste if changes in fixed data are required. Another disadvantage of this process is that the technique requires printing to be carried out using different printing engines and different imaging members, which makes maintaining accurate registration of the variable data and fixed data difficult.

Another prior art approach to printing fixed data and variable data is to use laser xerography to print both the fixed data and the variable data is to use laser xerography to print both the fixed data the variable data simultaneously. Since the photoreceptor must be laser-scanned once for each print, however, high speed printing at high resolution requires the use of massive memory and high data transfer rate and is thus a very expensive process. A trade-off between resolution and throughput speed becomes necessary.

The most desirable approach would be to use the same imaging member or process for printing both the fixed data and the variable data and to combine the advantages of a master-based printing system for printing the fixed data high resolution images and the advantages of a photoreceptor-based printing system for printing the lower resolution variable data. Since the fixed data high resolution images need to be written only once to yield a printing master, high resolution high speed printing could be obtained at much lower cost.

U.S. Pat. No. 4,835,570 (Robson), the disclosure of which is totally incorporated herein by reference, discloses an apparatus in which fixed and variable indicia are printed on a receiving member. One portion of a xeroprinting master has an imagewise pattern corresponding to the fixed indicia formed thereon. The xeroprinting master is uniformly charged and the portion thereof having the imagewise pattern formed thereon is uniformly exposed to light energy, which records a fixed electrostatic latent image corresponding to the fixed indicia thereon. Another portion of the charged xeroprinting master is selectively exposed to light energy to record a variable electrostatic latent image corresponding to the variable indicia thereon. The fixed and variable electrostatic latent images are developed, and the developed image is transferred to the receiving member to print the fixed and variable indicia thereon. The xeroprinting master can be a migration imaging member comprising, for example, a substrate (which may be conductive), an optional charge transport spacing layer, and a layer of softenable material containing a fracturable layer of migration marking material contiguous with the upper surface of the softenable layer. The master is uniformly charged by a corona generating device. Thereafter, the uniformly charged master is imagewise exposed to activating illumination. The light exposed xeroprinting master is then exposed to solvent vapor. Heat energy is then applied to the solvent treated xeroprinting master and the process for forming the electrostatic latent image thereon is completed. The xeromaster is made according to the process disclosed in U.S. Ser. No. 07/140,860 (U.S. Pat. No. 4,880,715). However, there are several disadvantages of this xeromaster when it is used for printing fixed and variable data, including the undersirable treatment with the vapor of a flammable organic solvent for master-making. Additionally, during the xeroprinting process, the charged xeromaster is selectively discharged (in non-imaged areas) to record the variable data. The electrostatic contrast voltage for the variable data is about 85–90 percent of the initially applied voltage. If the xeromaster is initially charged to 800 volts, the contrast voltage for the variable data is about 680–720 volts. On the other hand, the maximum electrostatic contrast voltage for the fixed data is about 60 percent of the initially applied voltage. Thus, the contrast voltage for the fixed data image is about 480 volts. The significantly different contrast voltages for the fixed data and variable data can cause non-uniform xerographic development and therefore non-uniform printing.

U.S. Pat. No. 4,124,286 (Barasch) discloses a method and apparatus for xerographically printing a composite record based on first and second complementary sources of information. The first source of information is imaged onto a photoconductive medium having the property of persistent conductivity to form a conductive image representative thereof. The conductive image is then transferred onto a second photoconductive medium in the form of a latent electrostatic image. The second, complementary source of information is imaged onto the second photoconductive medium, preferably by a scanning laser, as an overlay on the image of the first source. The composite electrostatic image so formed is then developed by the application of toner material and transferred onto a record medium.

U.S. Pat. No. 4,167,324 (Wu) discloses an apparatus for xerographically printing a composite record based on fixed and variable data. A first source of information is imaged onto a photoconductive drum to form a first electrostatic image thereof. The second, complementary source of information may be derived from a central processing unit in signal form. The signals received from the CPU are used to modulate the output beam of a scanning laser. The modulated laser output beam is directed to a stylus belt positioned in close surface proximity to the photoconductive drum bearing the first electrostatic image. The stylus belt includes an electrically conductive layer and a photoconductive layer, and is responsive to the incident laser energy to translate it into a corresponding charge pattern. This charge pattern is overlaid on the first electrostatic image to form a composite electrostatic image. The composite image is then developed and transferred onto a record medium in a conventional manner.

While known imaging members and processes are suitable for their intended purposes, a need remains for improved processes which allow simultaneous printing of fixed and variable data using the same imaging member and the same printing engine, thus avoiding the problem of mis-registration of the variable data relative to the fixed data. A need also remains for improved processes that allow simultaneous printing of fixed data and variable data at high speed, high resolution and low cost. Further, there is a need for processes for simultaneously printing fixed data and variable data by a xeroprinting method employing heat development of the master, wherein no flammable volatile organic solvents are required. Heat development generally is preferred to vapor or solvent development for reasons of ease of implementation in a machine/office environment, speed, cost, simplicity, and solvent containment and recovery difficulties. There is also a need for processes for simultaneously printing fixed data and variable data by a xeroprinting method, wherein the fixed data areas and the variable data areas of the xeromaster exhibit substantially similar electrostatic contrast voltages or contrast potentials. Additionally, there is a need for processes for simultaneously printing fixed data and variable data by a xeroprinting method wherein high electrostatic contrast voltages or contrast potentials of over 90 percent of charge acceptance are obtained on the xeromaster. In addition, a need remains for processes for simultaneously printing fixed data and variable data that result in uniformly high quality images.

SUMMARY OF THE INVENTION

It is an object of the present invention to provide improved processes for simultaneously printing fixed data and variable data.

It is another object of the present invention to provide processes that allow simultaneous printing of fixed and variable data using the same imaging member and the same printing engine.

It is another object of the present invention to provide processes for simultaneously printing fixed data and variable data that allow simultaneously printing fixed data and variable data at high speed, high resolution and low cost.

It is still another object of the present invention to provide processes for simultaneously printing fixed data and variable data by a xeroprinting method employing heat development of the master, wherein no flammable volatile organic solvents are required.

It is yet another object of the present invention to provide processes for simultaneously printing fixed data and variable data by a xeroprinting method, wherein the fixed data areas and the variable data areas of the xeromaster exhibit substantially similar electrostatic contrast voltages or contrast potentials.

Another object of the present invention is to provide processes for simultaneously printing fixed data and variable data by a xeroprinting method wherein high electrostatic contrast voltages or contrast potentials of over 90 percent are obtained on the xeromaster.

Yet another object of the present invention is to provide rapid, cost effective methods for simultaneously printing fixed data and variable data wherein high quality images are obtained.

These and other objects of the present invention (or specific embodiments thereof) can be achieved by providing an imaging process for simultaneous printing of fixed and variable data which comprises, in the order stated, (1) providing a migration imaging member comprising a substrate, a softenable layer comprising a softenable material and migration marking material contained at or near the surface of the softenable layer, and a charge transport material capable of transporting charges of one polarity; (2) uniformly charging the imaging member; (3) exposing the charged imaging member to activating radiation in an imagewise pattern corresponding to the fixed data, thereby forming an electrostatic latent image on the imaging member; (4) thereafter causing the softenable material to soften by the application of heat, thereby enabling the migration marking material exposed to radiation to migrate through the softenable material toward the substrate in an imagewise pattern corresponding to the fixed data; (5) uniformly charging the imaging member to the same polarity as the polarity of the charges that the charge transport material in the softenable layer is capable of transporting; (6) exposing the charged imaging member to activating radiation in an imagewise pattern corresponding to the variable data, thereby creating an electrostatic latent image on the imaging member corresponding to the variable data in areas of the imaging member wherein the migration marking material has not migrated; (7) uniformly charging the imaging member to the polarity opposite to the polarity of the charges that the charge transport material in the softenable layer is capable of transporting; (8) uniformly exposing the charged member to activating radiation, thereby forming an electrostatic latent image corresponding to both the fixed data and the variable data; (9) developing the electrostatic latent image; and (10) transferring the developed image to a receiver sheet.

DETAILED DESCRIPTION OF THE INVENTION

The process of the present invention entails the use of an imaging member comprising a substrate and a layer of softenable material containing migration marking material and a charge transport material. Optional layers can also be present. An example of a migration imaging member suitable for the process of the present invention is illustrated schematically in FIG. 1.

Figure 1:
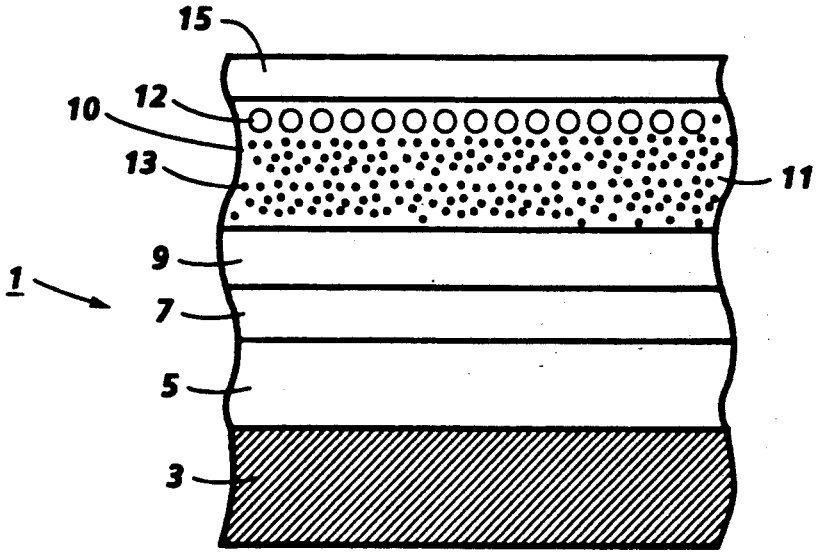
FIG. 1 illustrates schematically an imaging member suitable for the process of the present invention.

As illustrated schematically in FIG. 1, migration imaging member 1 comprises a substrate 3, an optional adhesive layer 5 situated on the substrate, an optional charge blocking layer 7 situated on optional adhesive layer 5, an optional charge transport layer 9 situated on optional charge blocking layer 7, and a softenable layer 10 situated on optional charge transport layer 9, said softenable layer 10 comprising softenable material 11, migration marking material 12 situated at or near the surface of the layer spaced from the substrate, and charge transport material 13 dispersed throughout softenable material 11. Optional overcoating layer 15 is situated on the surface of softenable layer 10 spaced from the substrate 3. Any or all of the optional layers can be absent from the imaging member. In addition, any of the optional layers present need not be in the order shown, but can be in any suitable arrangement. The migration imaging member can be in any suitable configuration, such as a web, a foil, a laminate, a strip, a sheet, a coil, a cylinder, a drum, an endless belt, and endless mobius strip, a circular disc, or any other suitable form.

The substrate can be either electrically conductive or electrically insulating. When conductive, the substrate can be opaque, translucent, semitransparent, or transparent, and can be of any suitable conductive material, including copper, brass, nickel, zinc, chromium, stainless steel, conductive plastics and rubbers, aluminum, semitransparent aluminum, steel, cadmium, silver, gold, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. When insulative, the substrate can be opaque, translucent, semitransparent, or transparent, and can be of any suitable insulative material, such as paper, glass, plastic, polyesters such as Mylar® (available from Du Pont) or Melinex® 442 (available from ICI Americas, Inc.), and the like. In addition, the substrate can comprise an insulative layer with a conductive coating, such as vacuum-deposited metallized plastic, such as titanized or aluminized Mylar® polyester, wherein the metallized surface is in contact with the softenable layer or any other layer situated between the substrate and the softenable layer. The substrate has any effective thickness, typically from about 6 to about 250 microns, and preferably from about 50 to about 200 microns, although the thickness can be outside of this range.

The softenable layer can comprise one or more layers of softenable materials, which can be any suitable material, typically a plastic or thermoplastic material which is soluble in a solvent or softenable, for example, in a solvent liquid, solvent vapor, heat, or any combinations thereof. When the softenable layer is to be softened or dissolved either during or after imaging, it should be soluble in a solvent that does not attack the migration marking material. By softenable is meant any material that can be rendered by a development step as described herein permeable to migration material migrating through its bulk. This permeability typically is achieved by a development step entailing dissolving, melting, or softening by contact with heat, vapors, partial solvents, as well as combinations thereof. Examples of suitable softenable materials include styrene-acrylic copolymers, such as styrene-hexylmethacrylate copolymers, styrene acrylate copolymers, styrene butylmethacrylate copolymers, styrene butylacrylate ethylacrylate copolymers, styrene ethylacrylate acrylic acid copolymers, and the like, polystyrenes, including polyalphamethyl styrene, alkyd substituted polystyrenes, styrene-olefin copolymers, styrene-vinyltoluene copolymers, polyesters, polyurethanes, polycarbonates, polyterpenes, silicone elastomers, mixtures thereof, copolymers thereof, and the like, as well as any other suitable materials as disclosed, for example, in U.S. Pat. No. 3,975,195 and other U.S. patents directed to migration imaging members which have been incorporated herein by reference. The softenable layer can be of any effective thickness, typically from about 1 to about 30 microns, and preferably from about 2 to about 25 microns, although the thickness can be outside of this range. The softenable layer can be applied to the conductive layer by any suitable coating process. Typical coating processes include draw bar coating, spray coating, extrusion, dip coating, gravure roll coating, wire-wound rod coating, air knife coating and the like.

The softenable layer also contains migration marking material. The migration marking material can be electrically photosensitive, photoconductive, or of any other suitable combination of materials, or possess any other desired physical property and still be suitable for use in the migration imaging members of the present invention. The migration marking materials preferably are particulate, wherein the particles are closely spaced from each other. Preferred migration marking materials generally are spherical in shape and submicron in size. The migration marking material generally is capable of substantial photodischarge upon electrostatic charging and exposure to activating radiation and is substantially absorbing and opaque to activating radiation in the spectral region where the photosensitive migration marking particles photogenerate charges. The migration marking material is generally present as a thin layer or monolayer of particles situated at or near the surface of the softenable layer spaced from the conductive layer. When present as particles, the particles of migration marking material preferably have an average diameter of up to 2 microns, and more preferably of from about 0.1 to about 1 micron. The layer of migration marking particles is situated at or near that surface of the softenable layer spaced from or most distant from the conductive layer. Preferably, the particles are situated at a distance of from about 0.01 to 0.1 micron from the layer surface, and more preferably from about 0.02 to 0.08 micron from the layer surface. Preferably, the particles are situated at a distance of from about 0.005 to about 0.2 micron from each other, and more preferably at a distance of from about 0.05 to about 0.1 micron from each other, the distance being measured between the closest edges of the particles, i.e. from outer diameter to outer diameter. The migration marking material contiguous to the outer surface of the softenable layer is present in any effective amount, preferably from about 5 to about 25 percent by total weight of the softenable layer, and more preferably from about 10 to about 20 percent by total weight of the softenable layer, although the amount can be outside of this range.

Examples of suitable migration marking materials include selenium, alloys of selenium with alloying components such as tellurium, arsenic, mixtures thereof, and the like, phthalocyanines, and any other suitable materials as disclosed, for example, in U.S. Pat. No. 3,975,195 and other U.S. patents directed to migration imaging members and incorporated herein by reference.

The migration marking particles can be included in the imaging members by any suitable technique. For example, a layer of migration marking particles can be placed at or just below the surface of the softenable layer by solution coating the first conductive layer with the softenable layer material, followed by heating the softenable material in a vacuum chamber to soften it, while at the same time thermally evaporating the migration marking material onto the softenable material in a vacuum chamber. Other techniques for preparing monolayers include cascade and electrophoretic deposition. An example of a suitable process for depositing migration marking material in the softenable layer is disclosed in U.S. Pat. No. 4,482,622, the disclosure of which is totally incorporated herein by reference.

The migration imaging members contain a charge transport material. The charge transport material contained in the softenable layer can be any suitable charge transport material either capable of acting as a softenable layer material or capable of being dissolved or dispersed on a molecular scale in the softenable layer material. When a charge transport material is also contained in another layer in the imaging member, preferably there is continuous transport of charge through the entire film structure. The charge transport material is defined as a material which is capable of improving the charge injection process for one sign of charge from the migration marking material into the softenable layer and also of transporting that charge through the softenable layer. The charge transport material can be either a hole transport material (transports positive charges) or an electron transport material (transports negative charges). The sign of the charge used to sensitize the migration imaging member during preparation of the master can be of either polarity. Charge transporting materials are well known in the art. Typical charge transporting materials include the following:

Diamine transport molecules of the type described in U.S. Pat. Nos. 4,306,008, 4,304,829, 4,233,384, 4,115,116, 4,299,897and 4,081,274, the disclosures of each of which are totally incorporated herein by reference. Typical diamine transport molecules include N,N'-diphenyl-N,N'-bis(3''-methylphenyl)-(1,1'-biphenyl)-4,4'-diamine, N,N'-diphenyl-N,N'-bis(4-methylphenyl-(1,1'-biphenyl)-4,4'-diamine, N,N'-diphenyl-N,N'-bis(2-methylphenyl)-(1,1'-biphenyl)-4,4'-diamine, N,N'-diphenyl-N,N'-bis(3-ethylphenyl)-(1,1'-biphenyl)-4,4'-diamine, N,N'-diphenyl-N,N'-bis(4-ethylphenyl)-(1,1'-biphenyl)-4,4'-diamine, N,N'-diphenyl-N,N'-bis(4-n-butylphenyl)-(1,1'-biphenyl)-4,4'-diamine, N,N'-diphenyl-N,N'-bis(3-chlorophenyl)-[1,1'-biphenyl]-4,4'-diamine, N,N'-diphenyl-N,N'-bis(4-chlorophenyl)-[1,1'-biphenyl]-4,4'-diamine, N,N'-diphenyl-N,N'-bis(phenylmethyl)-[1,1'-biphenyl]-4,4'-diamine, N,N,N',N'-tetraphenyl-[2,2'-dimethyl-1,1'-biphenyl]-4,4'-diamine, N,N,N',N'-tetra-(4-methylphenyl)-[2,2'-dimethyl-1,1'-biphenyl]-4,4'-diamine, N,N'-diphenyl-N,N'-bis(4-methylphenyl)-[2,2'-dimethyl-1,1'-biphenyl]-4,4'-diamine, N,N'-diphenyl-N,N'-bis(2-methylphenyl)-[2,2'-dimethyl-1,1'-biphenyl]-4,4'-diamine, N,N'-diphenyl-N,N'-bis(3-methylphenyl)-[2,2'-dimethyl-1,1'-biphenyl]-4,4'-diamine, N,N'-diphenyl-N,N'-bis(3-methylphenyl)-pyrenyl-1,6-diamine, and the like.

Pyrazoline transport molecules as disclosed in U.S. Pat. Nos. 4,315,982, 4,278,746, and 3,837,851, the disclosures of each of which are totally incorporated herein by reference. Typical pyrazoline transport molecules include 1-[lepidyl-(2)]-3-(p-diethylaminophenyl)-5-(p-diethylaminophenyl)pyrazoline, 1-[quinolyl-(2)]-3-(p-diethylaminophenyl)-5-(p-diethylaminophenyl)pyrazoline, 1-[pyridyl-(2)]-3-(p-diethylaminostyryl)-5-(p-diethylaminophenyl)pyrazoline, 1-[6-methoxypyridyl-(2)]-3-(p-diethylaminostyryl)-5-(p-diethylaminophenyl)-pyrazoline, 1-phenyl-3-[p-dimethylaminostyryl]-5-(p-dimethylaminostyryl)pyrazoline, 1-phenyl-3-[p-diethylaminostyryl]-5-(p-diethylaminostyryl)pyrazoline, and the like.

Substituted fluorene charge transport molecules as described in U.S. Pat. No. 4,245,021, the disclosure of which is totally incorporated herein by reference. Typical fluorene charge transport molecules include 9-(4'-dimethylaminobenzylidene)fluorene, 9-(4'-methoxybenzylidene)fluorene, 9-(2',4'-dimethoxybenzylidene)fluorene, 2-nitro-9-benzylidene-fluorene,2-nitro-9-(4'-diethylaminobenzylidene)fluorene, and the like.

Oxadiazole transport molecules such as 2,5-bis(4-diethylaminophenyl)-1,3,4-oxadiazole, pyrazoline, imidazole, triazole, and the like. Other typical oxadiazole transport molecules are described, for example, in German Patent 1,058,836, German Patent 1,060,260, and German Patent 1,120,875, the disclosures of each of which are totally incorporated herein by reference.

Hydrazone transport molecules, such as p-diethylamino benzaldehyde-(diphenylhydrazone), o-ethoxy-p-diethylaminobenzaldehyde-(diphenylhydrazone), o-methyl-p-diethylaminobenzaldehyde-(diphenylhydrazone), o-methyl-p-dimethylaminobenzaldehyde-(diphenylhydrazone), 1-naphthalenecarbaldehyde 1-methyl-1-phenylhydrazone, 1-naphthalenecarbaldehyde 1,1-phenylhydrazone, 4-methoxynaphthlene-1-carbaldeyde 1-methyl-1-phenylhydrazone, and the like. Other typical hydrazone transport molecules are described, for example in U.S. Pat. Nos. 4,150,987, 4,385,106, 4,338,388, and 4,387,147, the disclosures of each of which are totally incorporated herein by reference.

Carbazole phenyl hydrazone transport molecules such as 9-methylcarbazole-3-carbaldehyde-1,1-diphenylhydrazone, 9-ethylcarbazole-3-carbaldehyde-1-methyl-1-phenylhydrazone, 9-ethylcarbazole-3-carbaldehyde-1-ethyl-1-phenylhydrazone, 9-ethylcarbazole-3-carbaldehyde-1-ethyl-1-benzyl-1-phenylhydrazone, 9-ethylcarbazole-3-carbaldehyde-1,1-diphenylhydrazone, and the like. Other typical carbazole phenyl hydrazone transport molecules are described, for example, in U.S. Pat. No. 4,256,821 and U.S. Pat. No. 4,297,426, the disclosures of each of which are totally incorporated herein by reference.

Vinyl-aromatic polymers such as polyvinyl anthracene, polyacenaphthylene; formaldehyde condensation products with various aromatics such as condensates of formaldehyde and 3-bromopyrene; 2,4,7-trinitrofluorenone, and 3,6-dinitro-N-t-butylnaphthalimide as described, for example, in U.S. Pat. No. 3,972,717, the disclosure of which is totally incorporated herein by reference.

Oxadiazole derivatives such as 2,5-bis-(p-diethylaminophenyl)-oxadiazole-1,3,4 described in U.S. Pat. No. 3,895,944, the disclosure of which is totally incorporated herein by reference.

Tri-substituted methanes such as alkyl-bis(N,N-dialkylaminoaryl)methane, cycloalkyl-bis(N,N-dialkylaminoaryl)methane, and cycloalkenyl-bis(N,N-dialkylaminoaryl)methane as described in U.S. Pat. No.

3,820,989, the disclosure of which is totally incorporated herein by reference.

9-Fluorenylidene methane derivatives having the formula

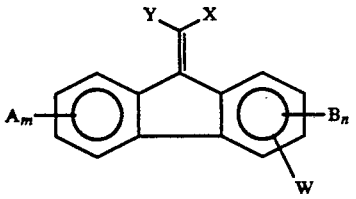

wherein X and Y are cyano groups or alkoxycarbonyl groups; A, B, and W are electron withdrawing groups independently selected from the group consisting of acyl, alkoxycarbonyl, nitro, alkylaminocarbonyl, and derivatives thereof; m is a number of from 0 to 2; and n is the number 0 or 1 as described in U.S. Pat. No. 4,474,865, the disclosure of which is totally incorporated herein by reference. Typical 9-fluorenylidene methane derivatives encompassed by the above formula include (4-n-butoxycarbonyl-9-fluorenylidene)-malonontrile, (4-phenethoxycarbonyl-9-fluorenylidene)malonontrile, (4-carbitoxy-9-fluorenylidene)malonontrile, (4-n-butoxycarbonyl-2,7-dinitro-9-fluorenylidene)malonate, and the like.

Other charge transport materials include poly-1-vinylpyrene, poly-9-vinylanthracene, poly-9-(4-pentenyl)-carbazole, poly-9-(5-hexyl)-carbazole, polymethylene pyrene, poly-1-(pyrenyl)-butadiene, polymers such as alkyl, nitro, amino, halogen, and hydroxy substitute polymers such as poly-3-amino carbazole, 1,3-dibromo-poly-N-vinyl carbazole, 3,6-dibromo-poly-N-vinyl carbazole, and numerous other transparent organic polymeric or non-polymeric transport materials as described in U.S. Pat. No. 3,870,516, the disclosure of which is totally incorporated herein by reference. Also suitable as charge transport materials are phthalic anhydride, tetrachlorophthalic anhydride, benzil, mellitic anhydride, S-tricyanobenzene, picryl chloride, 2,4-dinitrochlorobenzene, 2,4-dinitrobromobenzene, 4-nitrobiphenyl, 4,4-dinitrophenyl, 2,4,6-trinitroanisole, trichlorotrinitrobenzene, trinitro-O-toluene, 4,6-dichloro-1,3-dinitrobenzene, 4,6-dibromo-1,3-dinitrobenzene, P-dinitrobenzene, chloranil, bromanil, and mixtures thereof, 2,4,7-trinitro-9-fluorenone, 2,4,5,7-tetranitrofluorenone, trinitroanthracene, dinitroacridene, tetracyanopyrene, dinitroanthraquinone, polymers having aromatic or heterocyclic groups with more than one strongly electron withdrawing substituent such as nitro, sulfonate, carboxyl, cyano, or the like, including polyesters, polysiloxanes, polyamides, polyurethanes, and epoxies, as well as block, graft, or random copolymers containing the aromatic moiety, and the like, as well as mixtures thereof, as described in U.S. Pat. No. 4,081,274, the disclosure of which is totally incorporated herein by reference.

When the charge transport molecules are combined with an insulating binder to form the softenable layer, the amount of charge transport molecule which is used can vary depending upon the particular charge transport material and its compatibility (e.g. solubility) in the continuous insulating film forming binder phase of the softenable matrix layer and the like. Satisfactory results have been obtained using between about 5 percent to about 50 percent by weight charge transport molecule based on the total weight of the softenable layer. A particularly preferred charge transport molecule is one having the general formula

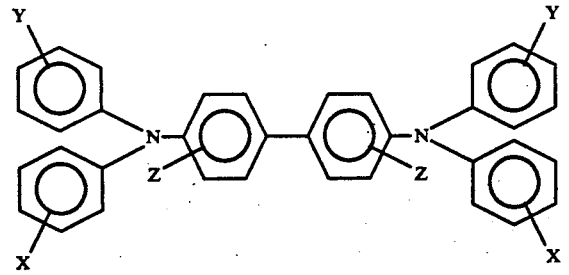

wherein X, Y and Z are selected from the group consisting of hydrogen, an alkyl group having from 1 to about 20 carbon atoms and chlorine, and at least one of X, Y and Z is independently selected to be an alkyl group having from 1 to about 20 carbon atoms or chlorine. If Y and Z are hydrogen, the compound can be named N,N'-diphenyl-N,N'-bis(alkylphenyl)-[1,1'-biphenyl]-4,4'-diamine wherein the alkyl is, for example, methyl, ethyl, propyl, n-butyl, or the like, or the compound can be N,N'-diphenyl-N,N'-bis(chlorophenyl)-[1,1'-biphenyl]-4,4'-diamine. Excellent results can be obtained when the softenable layer contains between about 8 percent to about 40 percent by weight of these diamine compounds based on the total weight of the softenable layer. Optimum results are achieved when the softenable layer contains between about 16 percent to about 32 percent by weight of N,N'-diphenyl-N,N'-bis(3''-methylphenyl)-(1,1'-biphenyl)-4,4'-diamine based on the total weight of the softenable layer.

The charge transport material is present in the softenable material in any effective amount, typically from about 5 to about 50 percent by weight and preferably from about 8 to about 40 percent by weight, although the amount can be outside of this range. Alternatively, the softenable layer can employ the charge transport material as the softenable material if the charge transport material possesses the necessary film-forming characteristics and otherwise functions as a softenable material. The charge transport material can be incorporated into the softenable layer by any suitable technique. For example, it can be mixed with the softenable layer components by dissolution in a common solvent. If desired, a mixture of solvents for the charge transport material and the softenable layer material can be employed to facilitate mixing and coating. The charge transport molecule and softenable layer mixture can be applied to the substrate by any conventional coating process. Typical coating processes include draw bar coating, spray coating, extrusion, dip coating, gravure roll coating, wire-wound rod coating, air knife coating, and the like.

The optional adhesive layer can include any suitable adhesive material. Typical adhesive materials include copolymers of styrene and an acrylate, polyester resin such as DuPont 49000 (available from E.I. duPont de Nemours Company), copolymer of acrylonitrile and vinylidene chloride, polyvinyl acetate, polyvinyl butyral and the like and mixtures thereof. The adhesive layer can have any thickness, typically from about 0.05 to about 1 micron, although the thickness can be outside of this range. When an adhesive layer is employed, it preferably forms a uniform and continuous layer having a thickness of about 0.5 micron or less to ensure satisfactory discharge during the xeroprinting process. It can also optionally include charge transport molecules.

The optional charge transport layer can comprise any suitable film forming binder material. Typical film forming binder materials include styrene acrylate copolymers, polycarbonates, co-polycarbonates, polyesters, co-polyesters, polyurethanes, polyvinyl acetate, polyvinyl butyral, polystyrenes, alkyd substituted polystyrenes, styrene-olefin copolymers, styrene-co-n-hexylmethacrylate, an 80/20 mole percent copolymer of styrene and hexylmethacrylate having an intrinsic viscosity of 0.179 dl/gm; other copolymers of styrene and hexylmethacrylate, styrene-vinyltoluene copolymers, polyalpha-methylstyrene, mixtures thereof, and copolymers thereof. The above group of materials is not intended to be limiting, but merely illustrative of materials suitable as film forming binder materials in the optional charge transport layer. The film forming binder material typically is substantially electrically insulating and does not adversely chemically react during the xeroprinting master making and xeroprinting steps of the present invention. Although the optional charge transport layer has been described as coated on a substrate, in some embodiments, the charge transport layer itself can have sufficient strength and integrity to be substantially self supporting and can, if desired, be brought into contact with a suitable conductive substrate during the imaging process. As is well known in the art, a uniform deposit of electrostatic charge of suitable polarity can be substituted for a conductive layer. Alternatively, a uniform deposit of electrostatic charge of suitable polarity on the exposed surface of the charge transport spacing layer can be substituted for a conductive layer to facilitate the application of electrical migration forces to the migration layer. This technique of "double charging" is well known in the art. The charge transport layer is of any effective thickness, typically from about 1 to about 25 microns, and preferably from about 2 to about 20 microns.

Charge transport molecules suitable for the charge transport layer are described in detail herein. The specific charge transport molecule utilized in the charge transport layer of any given master can be identical to or different from the charge transport molecule employed in the adjacent softenable layer. Similarly, the concentration of the charge transport molecule utilized in the charge transport spacing layer of any given master can be identical to or different from the concentration of charge transport molecule employed in the adjacent softenable layer. When the charge transport material and film forming binder are combined to form the charge transport spacing layer, the amount of charge transport material used can vary depending upon the particular charge transport material and its compatibility (e.g. solubility) in the continuous insulating film forming binder. Satisfactory results have been obtained using between about 5 percent and about 50 percent based on the total weight of the optional charge transport spacing layer, although the amount can be outside of this range. The charge transport material can be incorporated into the charge transport layer by similar techniques to those employed for the softenable layer.

The optional charge blocking layer can be of various suitable materials, provided that the objectives of the present invention are achieved, including aluminum oxide, polyvinyl butyral, silane and the like, as well as mixtures thereof. This layer, which is generally applied by known coating techniques, is of any effective thickness, typically from about 0.05 to about 0.5 micron, and preferably from about 0.05 to about 0.1 micron. Typical coating processes include draw bar coating, spray coating, extrusion, dip coating, gravure roll coating, wire-wound rod coating, air knife coating and the like.

The optional overcoating layer can be substantially electrically insulating, or have any other suitable properties. The overcoating preferably is substantially transparent, at least in the spectral region where electromagnetic radiation is used for imagewise exposure step in the master making process and for the uniform exposure step in the xeroprinting process. The overcoating layer is continuous and preferably of a thickness up to about 1 to 2 microns. More preferably, the overcoating has a thickness of between about 0.1 and about 0.5 micron to minimize residual charge buildup. Overcoating layers greater than about 1 to 2 microns thick can also be used. Typical overcoating materials include acrylic-styrene copolymers, methacrylate polymers, methacrylate copolymers, styrene-butylmethacrylate copolymers, butymethacrylate resins, vinylchloride copolymers, fluorinated homo or copolymers, high molecular weight polyvinyl acetate, organosilicon polymers and copolymers, polyesters, polycarbonates, polyamides, polyvinyl toluene and the like. The overcoating layer generally protects the softenable layer to provide greater resistance to the adverse effects of abrasion during handling, master making, and xeroprinting. The overcoating layer preferably adheres strongly to the softenable layer to minimize damage. The overcoating layer can also have abhesive properties at its outer surface which provide improved resistance to toner filming during toning, transfer, and/or cleaning. The abhesive properties can be inherent in the overcoating layer or can be imparted to the overcoating layer by incorporation of another layer or component of abhesive material. These abhesive materials should not degrade the film forming components of the overcoating and preferably have a surface energy of less than about 20 ergs/cm$^2$. Typical abhesive materials include fatty acids, salts and esters, fluorocarbons, silicones, and the like. The coatings can be applied by any suitable technique such as draw bar, spray, dip, melt, extrusion or gravure coating. It will be appreciated that these overcoating layers protect the xeroprinting master before imaging, during imaging, after the members have been imaged, and during xeroprinting.

Further information concerning the structure, materials, and preparation of migration imaging members is disclosed in U.S. Pat. Nos. 3,975,195, 3,909,262, 4,536,457, 4,536,458, 4,013,462, copending application Ser. No. 07/141,011, U.S. Pat. Nos. 4,853,307, 4,880,715, U.S. application Ser. No. 590,959 (abandoned, filed Oct. 31, 1966), U.S. application Ser. No. 695,214 (abandoned, filed Jan. 2, 1968), U.S. application Ser. No. 000,172 (abandoned, filed Jan. 2, 1970, and P. S. Vincett, G. J. Kovacs, M. C. Tam, A. L. Pundsack, and P. H. Soden, *Migration Imaging Mechanisms, Exploitation, and Future Prospects of Unique Photographic Technologies*, XDM and AMEN, Journal of Imaging Science 30(4) July/August, pp. 183-191 (1986), the disclosures of each of which are totally incorporated herein by reference.

The migration imaging member is then imaged and developed to prepare a xeroprinting master for use in the process of the present invention. The process of preparing the master is illustrated schematically in FIGS. 2 through 4 and the process of xeroprinting with the master to print fixed data and variable data simultaneously is illustrated schematically in FIGS. 5 through 10.

Figure 2:
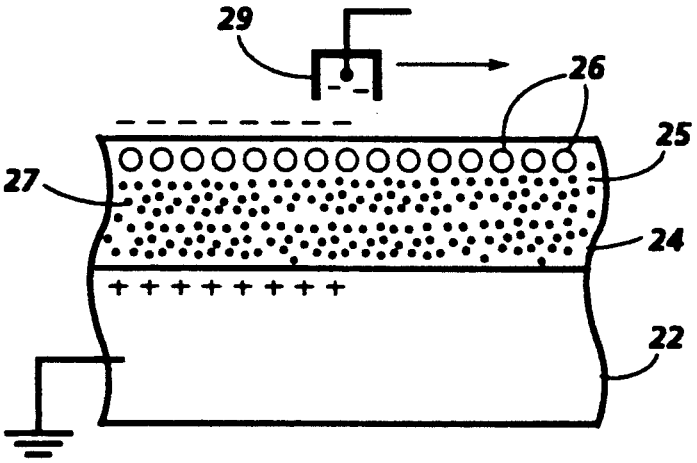
FIGS. 2, 3, and 4 illustrate schematically a process for preparing a xeroprinting master having an image thereon corresponding to the fixed data for use in the process of the present invention.

FIGS. 2 through 10 illustrate schematically a migration imaging member comprising a conductive substrate 22 that is connected to a reference potential such as a ground, a softenable layer 24 comprising softenable material 25, migration marking material 26, and charge transport material 27. To prepare a xeroprinting master, as shown in FIG. 2, the member is uniformly charged in the dark to either polarity (negative charging is illustrated in FIG. 2) by a charging means 29 such as a corona charging apparatus. Alternatively, the member can comprise an electrically insulating substrate instead of a conductive substrate and can be charged by electrostatically charging both sides of the member to surface potentials of opposite polarities.

Figure 3:
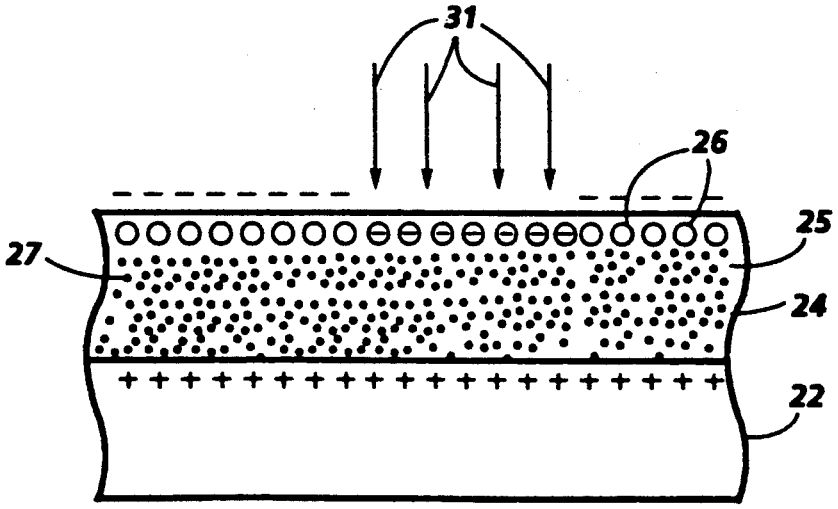

Subsequently, as illustrated schematically in FIG. 3, the charged member is exposed imagewise to activating radiation 31, such as light, prior to substantial dark decay of the uniform charge on the member surface, thereby forming an electrostatic latent image thereon corresponding to the desired fixed data image. Preferably, exposure to activating radiation is prior to the time when the uniform charge has undergone dark decay to a value of less than 50 percent of the initial charge, although exposure can be subsequent to this time provided that the objectives of the present invention are achieved.

Figure 4:
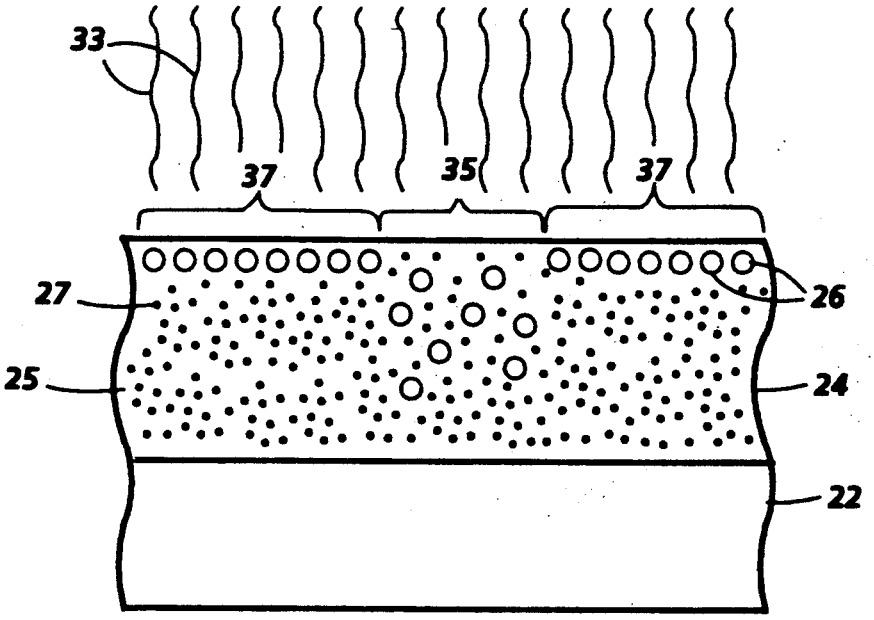

As illustrated schematically in FIG. 4, subsequent to imagewise exposure to form a latent image, the imaging member is developed by causing the softenable material to soften by the uniform application of heat energy 33 to the member. The heat development temperature and time depend upon factors such as how the heat energy is applied (e.g. conduction, radiation, convection, and the like), the melt viscosity of the softenable layer, thickness of the softenable layer, the amount of heat energy, and the like. For example, at a temperature of 110° C. to about 130° C., heat need only be applied for a few seconds. For lower temperatures, more heating time can be required. When the heat is applied, the softenable material 25 decreases in viscosity, thereby decreasing its resistance to migration of the marking material 26 through the softenable layer 24. In the exposed areas 35 of the imaging member, the migration marking material 26 gains a substantial net charge which, upon softening of the softenable material 25, causes the exposed marking material to migrate in image configuration towards the substrate 22 and disperse in the softenable layer 24, resulting in a $D_{min}$ area. The unexposed migration marking particles 26 in the unexposed areas 37 of the imaging member remain essentially neutral and uncharged. Thus, in the absence of migration force, the unexposed migration marking particles remain substantially in their original position in softenable layer 24, resulting in a $D_{max}$ area. Thus, as illustrated in FIG. 4, the developed image is an optically sign-retaining visible image of an original (if a conventional light-lens exposure system is utilized). Exposure can also be by means other than light-lens systems, including raster output scanning devices such as laser writers. The developed imaging member can then be employed as a xeroprinting master. The image pattern in the imaging member created by migrated and unmigrated marking particles corresponds to the fixed data image to be generated in the process of the present invention.

The imaged xeroprinting master shown in FIG. 4 is transmitting to visible light in the exposed region because of the depthwise migration and dispersion of the migration marking material in the exposed region. The $D_{min}$ obtained in the exposed region generally is slightly higher than the optical density of transparent substrates underlying the softenable layer. The $D_{max}$ in the unexposed region generally is essentially the same as the original unprocessed imaging member because the positions of migration marking particles in the unexposed regions remain essentially unchanged. Thus, optically sign-retained visible images with high optical contrast density in the region of 0.9 to 1.2 can be achieved for xeroprinting masters. In addition, exceptional resolution, such as 228 line pairs per millimeter, can be achieved on the xeroprinting masters.

The imaging member illustrated in FIGS. 2 through 10 is shown without any optional layers such as those illustrated in FIG. 1. If desired, alternative imaging member embodiments, such as those employing any or all of the optional layers illustrated in FIG. 1, can also be employed.

Figure 5:
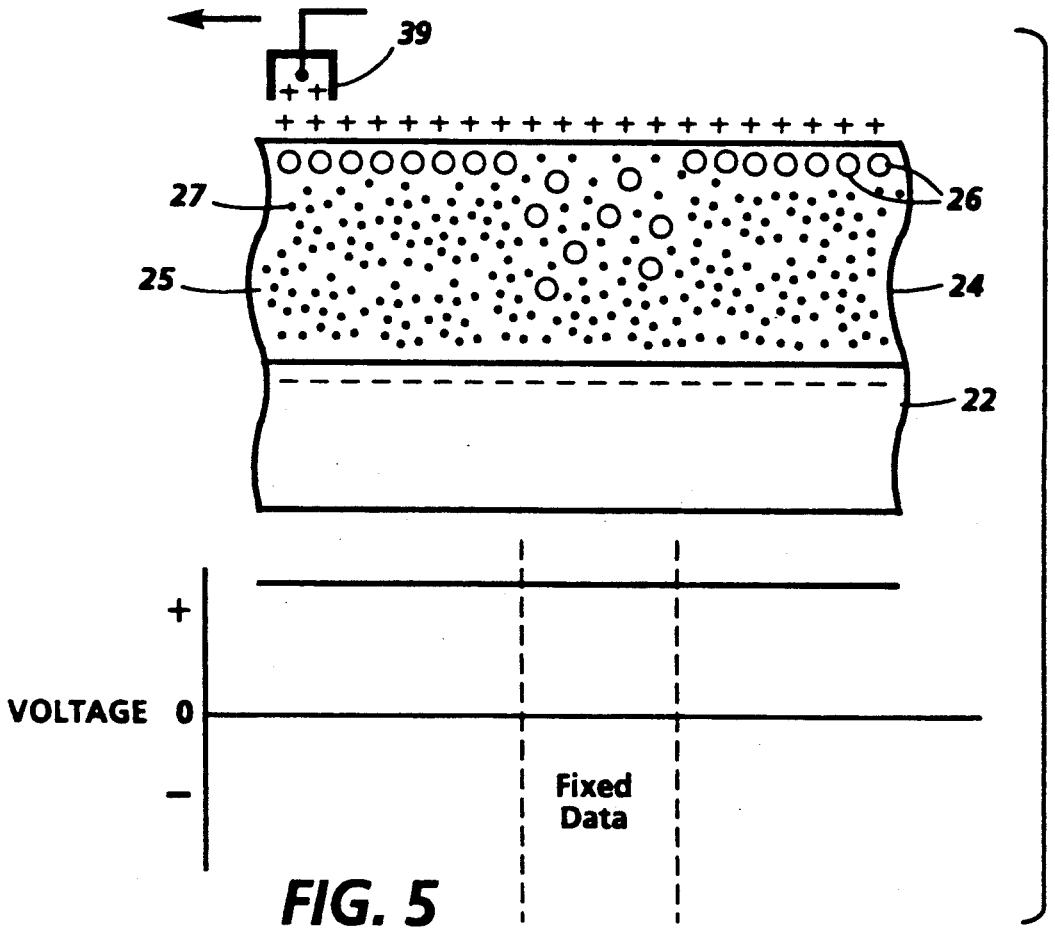
FIGS. 5, 6, 7, 8, 9, and 10 illustrate schematically a xeroprinting process for simultaneously printing fixed and variable data according to the present invention.

The prepared xeroprinting master as illustrated in FIG. 4 is then used in a xeroprinting process as illustrated schematically in FIGS. 5 through 10. As illustrated schematically in FIG. 5, the xeroprinting master is uniformly charged in the dark by a charging means 39 such as a corona charging device. Charging is to any effective magnitude; generally, positive or negative voltages of from about 50 to about 1,200 volts are suitable for the process of the present invention, although other values can be employed. The polarity of the charge applied depends on the nature of the charge transport material present in the master, and is of the same polarity as the type of charge of which the charge transport material is capable of transporting; thus, when the charge transport material in the softenable layer is capable of transporting holes (positive charges), the master is charged positively, and when the charge transport material in the softenable layer is capable of transporting electrons (negative charges), the master is charged negatively. As illustrated in FIG. 5, charge transport material 27 is capable of transporting holes; accordingly, the master is uniformly positively charged. In FIG. 5, the graph below the imaging member illustrates schematically and qualitatively the relatively high uniform positive charge present across the surface of the imaging member.

Figure 6:
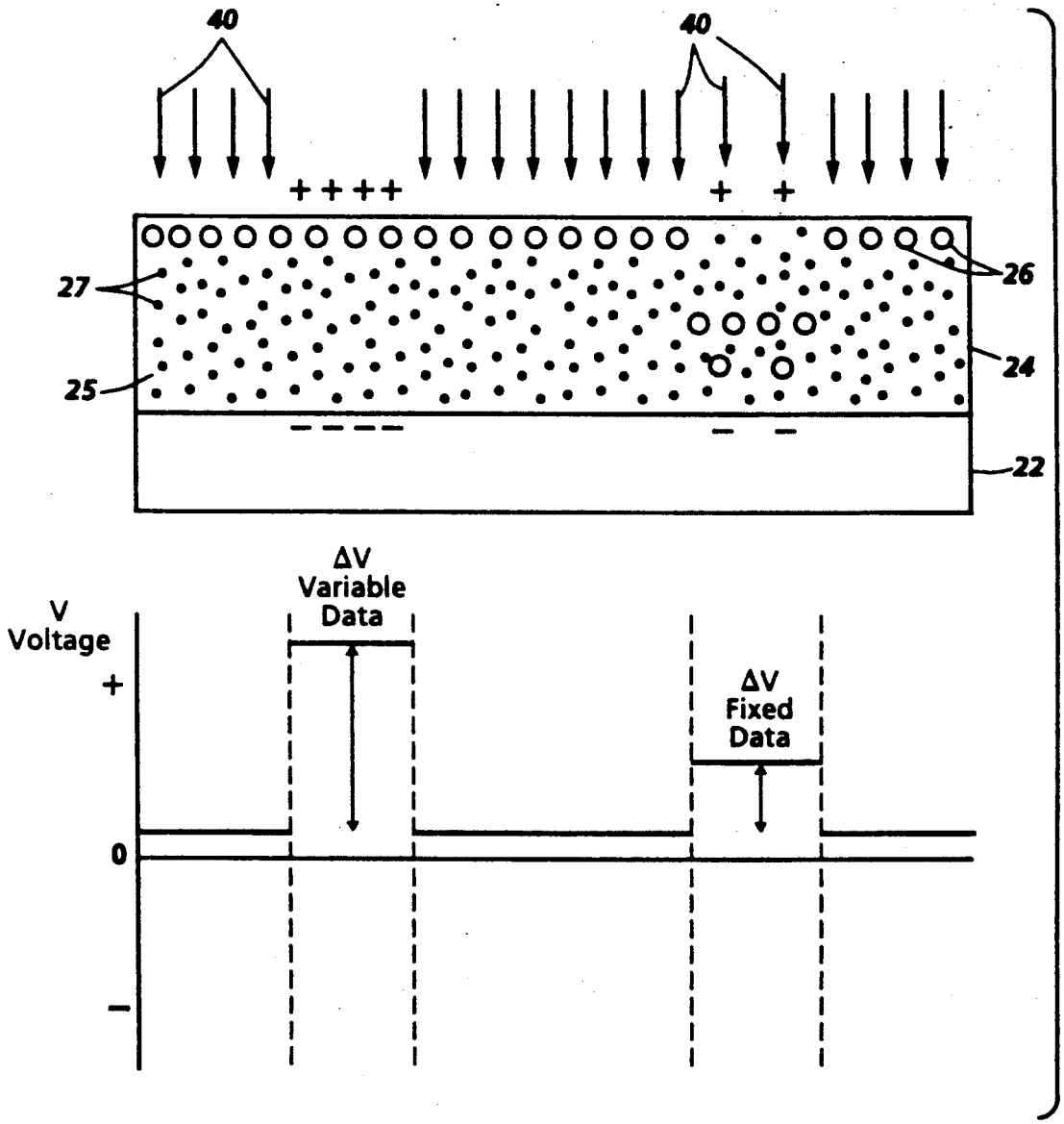

Subsequently, as illustrated schematically in FIG. 6, the charged master is exposed to activating radiation 40 in an imagewise pattern corresponding to the variable data image desired, thereby creating an electrostatic latent image on the imaging member corresponding to the variable data. In FIG. 6, the graph below the imaging member illustrates schematically and qualitatively the relative charge pattern across the surface of the imaging member. As shown, in areas wherein the migration marking material has not migrated through the softenable layer and where the imaging member remains unexposed to activating radiation (i.e., the variable data areas), the imaging member substantially retains its initial relatively high uniform positive charge. In areas wherein the migration marking material has not migrated through the softenable layer and where the imaging member has been exposed to activating radiation (i.e., the background areas), the imaging member is substantially discharged. The activating radiation should be in the spectral region where the migration marking material photogenerates charge carriers. Monochromatic light in the region of from about 300 to about 550 nanometers is generally preferred for selenium migration marking particles to maximize the photodischarge. The exposure energy should be sufficient to cause at least about 50 percent and preferably at least about 80 percent and even more preferably at least about 90 percent or more photodischarge from the initial voltage value. The difference in voltages between the exposed un-migrated areas (i.e., the background areas) and the non-exposed un-migrated areas (i.e., the variable data) of the master gives the contrast voltage for the variable data image. In areas wherein the migration marking material has migrated through the softenable layer (i.e., the fixed data areas) and where the imaging member has been exposed to activating radiation, the imaging member is discharged to a value the magnitude of which is intermediate between that observed in the non-exposed un-migrated areas (i.e. the variable data image areas) and that observed in the exposed un-migrated areas (i.e., the background areas) of the master. The difference in voltages between the exposed un-migrated areas (i.e., the background areas) and the exposed migrated areas (i.e. fixed data image areas) of the master gives the contrast voltage for the fixed data image. It has been observed that the maximum contrast voltage is about 45 to 50 percent of the initially applied voltage. The retention of some positive charge in the fixed data areas is a result of the difference in photodischarge characteristics between the areas of the imaging member wherein the migration marking material has migrated and areas of the imaging member wherein the migration marking material has not migrated.

When the xeroprinting master is charged to a polarity the same as the polarity of the type of charge of which the charge transport material is capable of transporting, the $D_{max}$ areas (areas where the migration marking material has not migrated toward the substrate) of the master photodischarge rapidly and nearly completely upon exposure to activating radiation. This effect is a result of the charge transport material being capable of transporting efficiently the photogenerated charge carriers to the conductive substrate when the master is charged to a polarity the same as the polarity of the type of charge of which the charge transport material was capable of transporting. The $D_{min}$ areas (areas where the migration marking material has migrated toward the substrate) also photodischarge upon exposure to the same activating radiation, but at a much lower rate. This effect is observed because the migration and dispersion of the migration marking material in $D_{min}$ areas has degraded the photosensitivity in the $D_{min}$ areas of the master, compared with the photosensitivity of the $D_{max}$ areas where the migration marking material remains substantially in its initial configuration. It is believed that particle to particle hopping transport causes photodischarge in the $D_{min}$ areas. Thus, illumination of the charged xeroprinting master charged to the same polarity as the polarity of the type of charge of which the charge transport material is capable of transporting causes photodischarge to occur predominately in the $D_{max}$ region of the image. Charge is substantially retained in the regions containing the migrated marking particles and is substantially dissipated in the regions containing the unmigrated particles.

Figure 7:
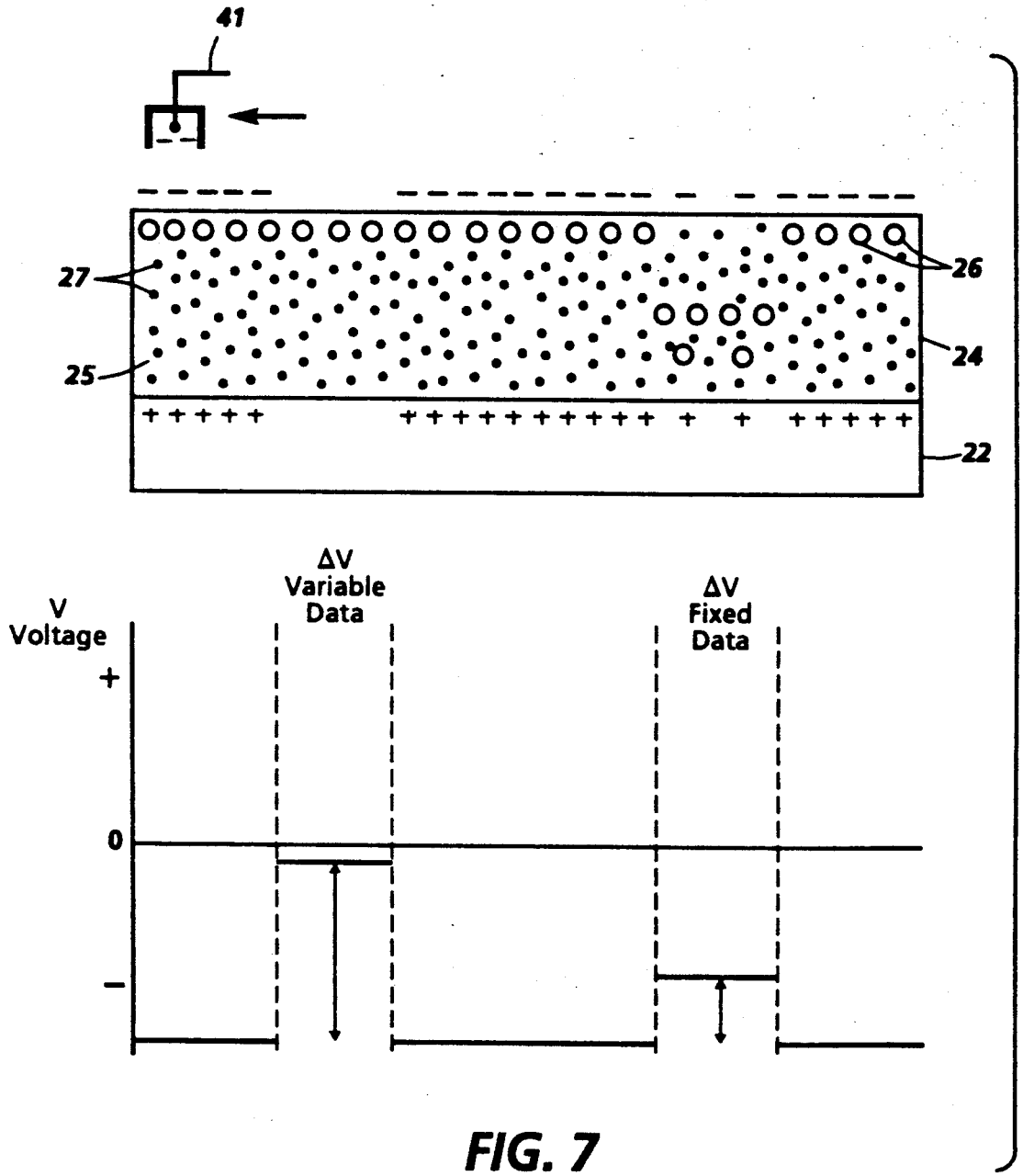

Thereafter, as illustrated schematically in FIG. 7, the master is uniformly charged to the polarity opposite to that used for charging in FIG. 5 by a charging means 41 such as a corona charging device. Charging is to any effective magnitude; generally, positive or negative voltages of from about 50 to about 1,200 volts are suitable for the process of the present invention, although other values can be employed. The magnitude of the uniformly applied charge preferably is substantially identical to or slightly greater than the charge used in FIG. 5 so that the non-migrated un-exposed areas (i.e. the variable data image) of the master become completely neutralized or slightly charged to a polarity opposite to that used in FIG. 5. If the variable data image areas become slightly charged after this step, the voltage obtained in the non-migrated un-exposed areas (i.e. the variable data image) of the master is preferably less than about 100 volts, more preferably less than about 50 volts, and even more preferably less than about 20 volts in magnitude and having a polarity opposite to that used for charging in FIG. 5. The polarity of the charge applied depends on the nature of the charge transport material present in the master, and is of the polarity opposite to the type of charge of which the charge transport material is capable of transporting; thus, when the charge transport material in the softenable layer is capable of transporting holes (positive charges), the master is charged negatively, and when the charge transport material in the softenable layer is capable of transporting electrons (negative charges), the master is charged positively. As illustrated in FIG. 7, charge transport material 27 is capable of transporting holes; accordingly, the master is uniformly negatively charged. In FIG. 7, the graph below the imaging member illustrates schematically and qualitatively the relative charge pattern across the surface of the imaging member. As shown, in areas wherein the migration marking material has not migrated through the softenable layer and where the imaging member was unexposed to activating radiation in FIG. 6 (i.e., the variable data image), the imaging member becomes slightly negatively charged. In areas wherein the migration marking material has not migrated through the softenable layer and where the imaging member was exposed to activating radiation in FIG. 6 (i.e., the background areas), the imaging member becomes relatively highly negatively charged. In areas wherein the migration marking material has migrated through the softenable layer and where the imaging member was exposed to activating radiation in FIG. 6 (i.e., the fixed data image), the imaging member becomes negatively charged, but to a magnitude which is substantially less than that obtained in the non-migrated exposed areas (i.e., the background areas) and which is substantially higher than that obtained in the non-migrated unexposed areas (i.e. the variable data image) of the master.

Figure 8:
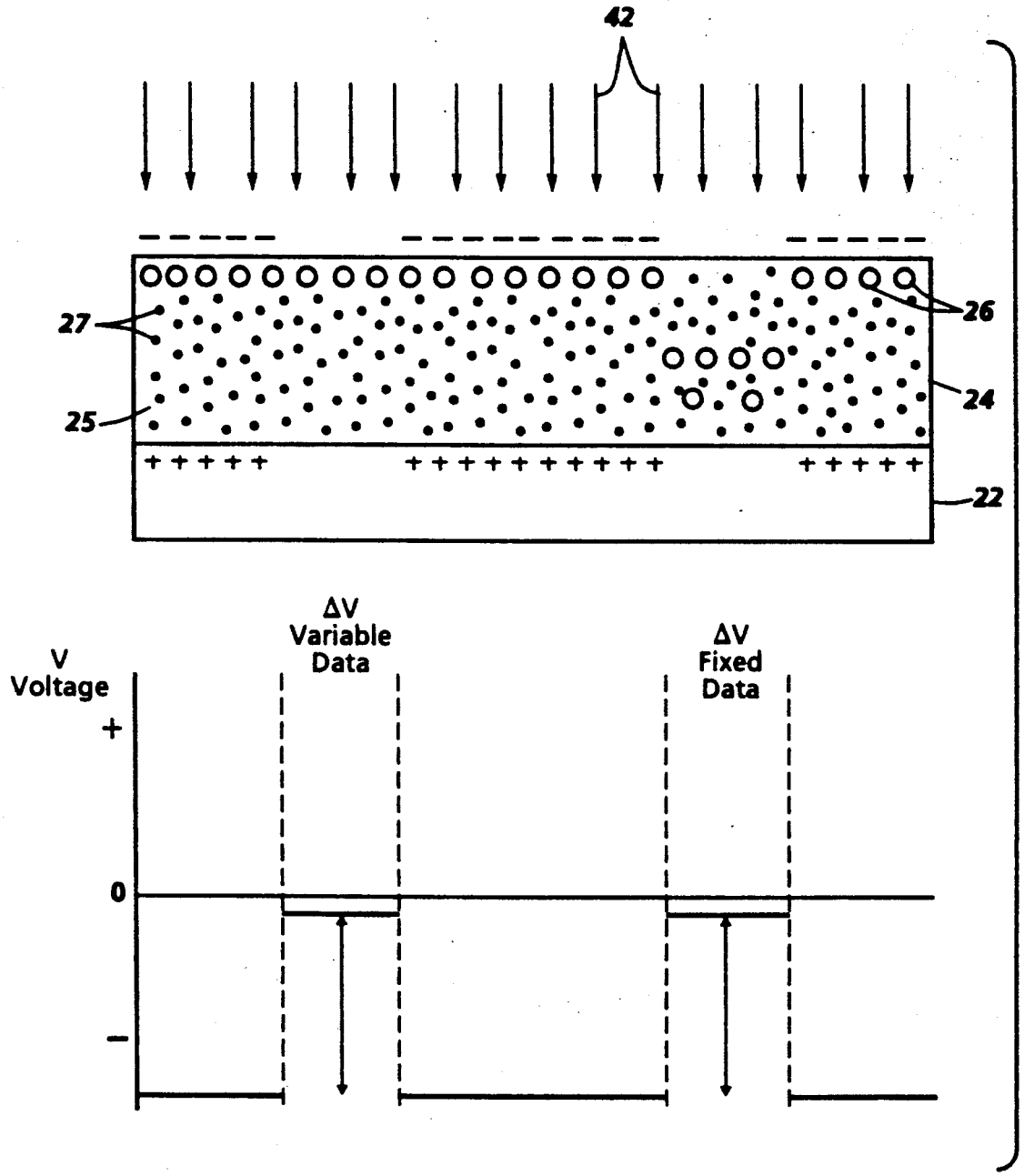

The xeroprinting master is then uniformly flash exposed to activating radiation 42 such as light energy as illustrated schematically in FIG. 8 to form an electrostatic latent image corresponding to both the fixed data areas and the variable data areas. The activating electromagnetic radiation used for the uniform exposure step should be in the spectral region where the migration marking particles photogenerate charge carriers. Light in the spectral region of 300 to 800 nanometers is generally suitable for the process of the present invention, although the wavelength of the light employed for exposure can be outside of this range, and is selected according to the spectral response of the specific migration marking particles selected. An exposure energy from about 10 ergs per square centimeter to about 100,000 ergs per square centimeter is generally suitable for the process of the present invention, although the exposure energy can be outside of this range. The exposure energy should be such that in areas wherein the migration marking material has migrated through the softenable layer (i.e., the fixed data areas), the imaging member becomes substantially photodischarged, preferably to about the same voltage as that of the variable data areas obtained in FIG. 7. The difference between the photodischarged voltage in the fixed data areas and the photodischarged voltage in the variable data areas is preferably less than 100 volts, more preferably less than 50 volts and even more preferably less than 20 volts. An exposure energy of at least 100 ergs per square centimeter is preferred for selenium particles to maximize the photodischarge. In areas where the migration marking material has not migrated through the softenable layer (the variable data image and the background areas), the imaging member remains substantially unaffected by the light exposure even when the intensity of the exposure light is greatly increased. This effect is observed because the photogenerated charge carriers cannot be transported to the conductive substrate when the master is charged to a polarity opposite to that the charge transport material is capable of transporting. In FIG. 8, the graph below the imaging member illustrates schematically and qualitatively the relative charge pattern across the surface of the imaging member. As shown, in areas wherein the migration marking material has not migrated through the softenable layer and where the imaging member was unexposed to activating radiation in FIG. 6 (i.e., the variable data areas), the imaging member remains substantially unaffected by the uniform flash exposure or retains the very slight negative charge present in FIG. 7 and the surface voltage remains substantially close to zero. In areas wherein the migration marking material has not migrated through the softenable layer and where the imaging member was exposed to activating radiation in FIG. 6 (i.e. the background areas) the imaging member remains relatively highly negatively charged as it was in FIG. 7. The contrast voltage for the variable data image is obtained by calculating the difference in voltage between the variable data areas and the background areas of the master. In areas wherein the migration marking material has migrated through the softenable layer (i.e., the fixed data areas) and where the imaging member was exposed to activating radiation in FIG. 6, the imaging member becomes substantially discharged to a negative voltage comparable in magnitude to that observed in the variable data areas. The contrast voltage for the fixed data image is obtained by calculating the difference in voltage between the fixed data areas and the background areas of the master. Since the voltage in fixed data areas becomes photodischarged to substantially the value as that in the variable data areas and the voltage in the background areas is the same for both areas, the electrostatic contrast voltages for the fixed data areas and variable data areas exhibit substantially the same magnitude. This effect results in the formation of a uniform image when the composite fixed data/variable data image is subsequently developed. Contrast voltage efficiency, determined by dividing the voltage difference between the image areas of the master and the background areas of the master by the initial voltage to which the master was charged prior to flood exposure and multiplying by 100 to obtain a percentage figure, can range from about 20 percent to about 95 percent for the process of the present invention, and preferably is from about 50 percent to about 95 percent, more preferably from about 60 percent to about 95 percent, and even more preferably is from about 90 percent to about 95 percent.

Figure 9:
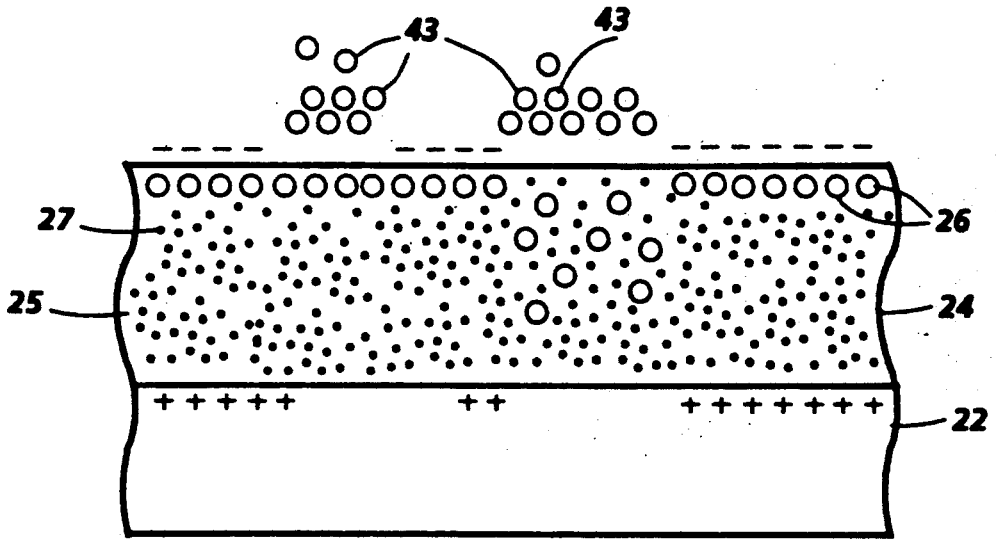

Subsequently, as illustrated in FIG. 9, the electrostatic latent image formed by flood exposing the charged master to light as shown in FIG. 8 is then developed with toner particles 43 to form a toner image corresponding to the electrostatic latent image. In FIG. 9, the toner particles 43 carry a negative electrostatic charge and are repelled by the negative charge in the background areas and will deposit in the discharged areas corresponding to the fixed and variable data images. However, if desired, the toner can be deposited in the charged areas by employing toner particles having opposite polarity to the charged areas (i.e., positively charged toner particles in the embodiment shown in FIG. 9). The toner particles 43 will then be attracted by the negative charges corresponding to the latent image and will deposit in the charged areas. Well known electrically biased development electrodes can also be employed, if desired, to direct toner particles to either the charged or discharged areas of the imaging surface.

The developing (toning) step is identical to that conventionally used in electrophotographic imaging. Any suitable conventional electrophotographic dry or liquid developer containing electrostatically attractable marking particles can be employed to develop the electrostatic latent image on the xeroprinting master. Typical dry toners have a particle size of between about 6 microns and about 20 microns. Typical liquid toners have a particle size of between about 0.1 micron and about 6 microns. The size of toner particles generally affects the resolution of prints. For applications demanding very high resolution, such as in color proofing and printing, liquid toners are generally preferred because their much smaller toner particle size gives better resolution of fine half-tone dots and produce four color images without undue thickness in densely toned areas. Conventional electrophotographic development techniques can be utilized to deposit the toner particles on the imaging surface of the xeroprinting master.

This invention is suitable for development with dry two-component developers. Two-component developers comprise toner particles and carrier particles. Typical toner particles can be of any composition suitable for development of electrostatic latent images, such as those comprising a resin and a colorant. Typical toner resins include polyesters, polyamides, epoxies, polyurethanes, diolefins, vinyl resins and polymeric esterification products of a dicarboxylic acid and a diol comprising a diphenol. Examples of vinyl monomers include styrene, p-chlorostyrene, vinyl naphthalene, unsaturated mono-olefins such as ethylene, propylene, butylene, isobutylene and the like; vinyl halides such as vinyl chloride, vinyl bromide, vinyl fluoride, vinyl acetate, vinyl propionate, vinyl benzoate, and vinyl butyrate; vinyl esters such as esters of monocarboxylic acids, including methyl acrylate, ethyl acrylate, n-butyl acrylate, isobutyl acrylate, dodecyl acrylate, n-octyl acrylate, 2-chloroethyl acrylate, phenyl acrylate, methylalpha-chloroacrylate, methyl methacrylate, ethyl methacrylate, butyl methacrylate, and the like; acrylonitrile, methacrylonitrile, acrylamide, vinyl ethers, including vinyl methyl ether, vinyl isobutyl ether, and vinyl ethyl ether; vinyl ketones such as vinyl methyl ketone, vinyl hexyl ketone, and methyl isopropenyl ketone; N-vinyl indole and N-vinyl pyrrolidene; styrene butadienes; mixtures of these monomers; and the like. The resins are generally present in an amount of from about 30 to about 99 percent by weight of the toner composition, although they can be present in greater or lesser amounts, provided that the objectives of the invention are achieved.

Any suitable pigments or dyes or mixture thereof can be employed in the toner particles. Typical pigments or dyes include carbon black, nigrosine dye, aniline blue, magnetites, and mixtures thereof, with carbon black being a preferred colorant. The pigment is preferably present in an amount sufficient to render the toner composition highly colored to permit the formation of a clearly visible image on a recording member. Generally, the pigment particles are present in amounts of from about 1 percent by weight to about 20 percent by weight based on the total weight of the toner composition; however, lesser or greater amounts of pigment particles can be present provided that the objectives of the present invention are achieved.

Other colored toner pigments include red, green, blue, brown, magenta, cyan, and yellow particles, as well as mixtures thereof. Illustrative examples of suitable magenta pigments include 2,9-dimethyl-substituted quinacridone and anthraquinone dye, identified in the Color Index as CI 60710, CI Dispersed Red 15, a diazo dye identified in the Color Index as CI 26050, CI Solvent Red 19, and the like. Illustrative examples of suitable cyan pigments include copper tetra-4-(octadecyl sulfonamido) phthalocyanine, X-copper phthalocyanine pigment, listed in the Color Index as CI 74160CI Pigment Blue, and Anthradanthrene Blue, identified in the Color Index as CI 69810, Special Blue X-2137, and the like. Illustrative examples of yellow pigments that can be selected include diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, Permanent Yellow FGL, and the like. These color pigments are generally present in an amount of from about 15 weight percent to about 20.5 weight percent based on the weight of the toner resin particles, although lesser or greater amounts can be present provided that the objectives of the present invention are met.

When the pigment particles are magnetites, which comprise a mixture of iron oxides ($Fe_3O_4$) such as those commercially available as Mapico Black, these pigments are present in the toner composition in an amount of from about 10 percent by weight to about 70 percent by weight, and preferably in an amount of from about 20 percent by weight to about 50 percent by weight, although they can be present in greater or lesser amounts, provided that the objectives of the invention are achieved.

The toner compositions can be prepared by any suitable method. For example, the components of the dry toner particles can be mixed in a ball mill, to which steel beads for agitation are added in an amount of approximately five times the weight of the toner. The ball mill can be operated at about 120 feet per minute for about 30 minutes, after which time the steel beads are removed. Dry toner particles for two-component developers generally have an average particle size between about 6 micrometers and about 20 micrometers.

Any suitable external additives can also be utilized with the dry toner particles. The amounts of external additives are measured in terms of percentage by weight of the toner composition, but are not themselves included when calculating the percentage composition of the toner. For example, a toner composition containing a resin, a pigment, and an external additive can comprise 80 percent by weight of resin and 20 percent by weight of pigment; the amount of external additive present is reported in terms of its percent by weight of the combined resin and pigment. External additives can include any additives suitable for use in electrostatographic toners, including straight silica, colloidal silica (e.g. Aerosil R972 ®available from Degussa, Inc.), ferric oxide, Unilin, polypropylene waxes, polymethylmethacrylate, zinc stearate, chromium oxide, aluminum oxide, stearic acid, polyvinylidene flouride (e.g. Kynar®, available from Pennwalt Chemicals Corporation), and the like. External additives can be present in any suitable amount, provided that the objectives of the present invention are achieved.

Any suitable carrier particles can be employed with the toner particles. Typical carrier particles include granular zircon, steel, nickel, iron ferrites, and the like. Other typical carrier particles include nickel berry carriers as disclosed in U.S. Pat. No. 3,847,604, the entire disclosure of which is incorporated herein by reference. These carriers comprise nodular carrier beads of nickel characterized by surfaces of reoccurring recesses and protrusions that provide the particles with a relatively large external area. The diameters of the carrier particles can vary, but are generally from about 50 microns to about 1,000 microns, thus allowing the particles to possess sufficient density and inertia to avoid adherence to the electrostatic images during the development process. Carrier particles can possess coated surfaces. Typical coating materials include polymers and terpolymers, including, for example, fluoropolymers such as polyvinylidene fluorides as disclosed in U.S. Pat. No. 3,526,533, U.S. Pat. No. 3,849,186, and U.S. Pat. No. 3,942,979, the disclosures of each of which are totally incorporated herein by reference. The toner may be present, for example, in the two-component developer in an amount equal to about 1 to about 5 percent by weight of the carrier, and preferably is equal to about 3 percent by weight of the carrier.

Typical dry toners are disclosed, for example, in U.S. Pat. No. 2,788,288, U.S. Pat. No. 3,079,342, and U.S. Pat. No. Re. 25,136, the disclosures of each of which are totally incorporated herein by reference.

If desired, development can be effected with liquid developers. Liquid developers are disclosed, for example, in U.S. Pat. No. 2,890,174 and U.S. Pat. No. 2,899,335, the disclosure of each of which are totally incorporated herein by reference. Liquid developers can comprise aqueous based or oil based inks, and include both inks containing a water or oil soluble dye substance and pigmented inks. Typical dye substances are Methylene Blue, commercially available from Eastman Kodak Company, Brilliant Yellow, commercially available from the Harlaco Chemical Company, potassium permanganate, ferric chloride and Methylene Violet, Rose Bengal and Quinoline Yellow, the latter three available from Allied Chemical Company, and the like. Typical pigments are carbon black, graphite, lamp black, bone black, charcoal, titanium dioxide, white lead, zinc oxide, zinc sulfide, iron oxide, chromium oxide, lead chromate, zinc chromate, cadmium yellow, cadmium red, red lead, antimony dioxide, magnesium silicate, calcium carbonate, calcium silicate, phthalocyanines, benzidines, naphthols, toluidines, and the like. The liquid developer composition can comprise a finely divided opaque powder, a high resistance liquid, and an ingredient to prevent agglomeration. Typical high resistance liquids include such organic dielectric liquids as paraffinic hydrocarbons such as the Isopar® and Norpar® family, carbon tetrachloride, kerosene, benzene, trichloroethylene, and the like. Other liquid developer components or additives include vinyl resins, such as carboxy vinyl polymers, polyvinylpyrrolidones, methylvinylether maleic anhydride interpolymers, polyvinyl alcohols, cellulosics such as sodium carboxy-ethylcellulose, hydroxypropylmethyl cellulose, hydroxyethyl cellulose, methyl cellulose, cellulose derivatives such as esters and ethers thereof, alkali soluble proteins, casein, gelatin, and acrylate salts such as ammonium polyacrylate, sodium polyacrylate, and the like.

Any suitable conventional electrophotographic development technique can be utilized to deposit toner particles on the electrostatic latent image on the imaging surface of the xeroprinting master. Well known electrophotographic development techniques include magnetic brush development, cascade development, powder cloud development, electrophoretic development, and the like. Magnetic brush development is more fully described, for example, in U.S. Pat. No. 2,791,949, the disclosure of which is totally incorporated herein by reference; cascade development is more fully described, for example, in U.S. Pat. No. 2,618,551 and U.S. Pat. No. 2,618,552, the disclosures of each of which are totally incorporated herein by reference; powder cloud development is more fully described, for example, in U.S. Pat. No. 2,725,305, U.S. Pat. No. 2,918,910, and U.S. Pat. No. 3,015,305, the disclosures of each of which are totally incorporated herein by reference; and liquid development is more fully described, for example, in U.S. Pat. No. 3,084,043, the disclosure of which is totally incorporated herein by reference.

Figure 10:
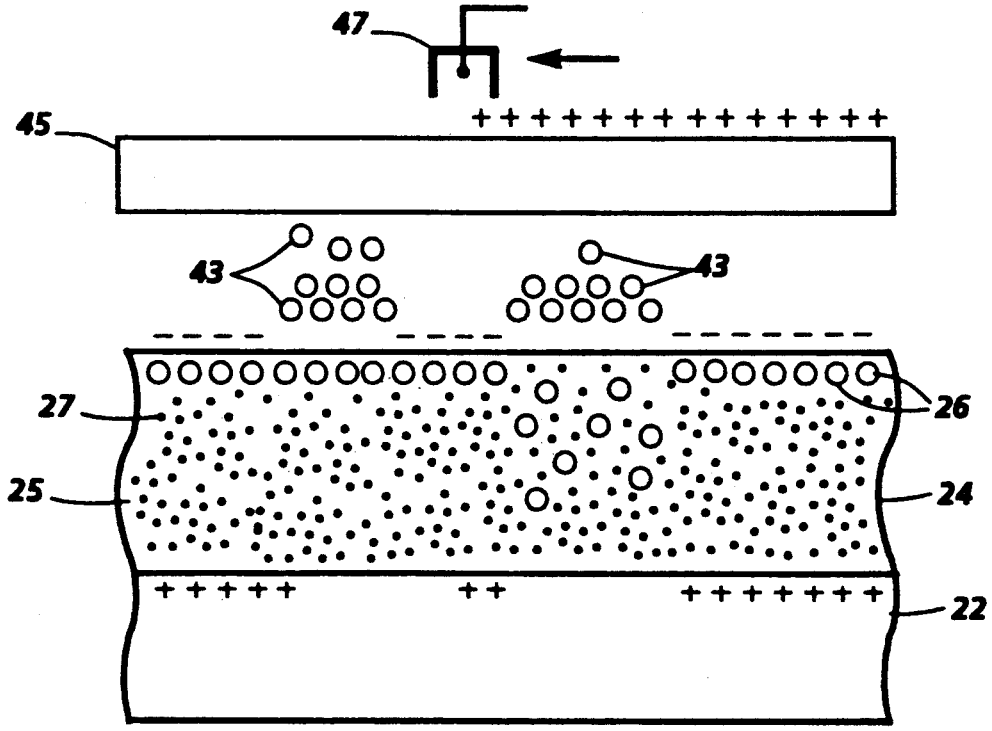

As illustrated schematically in FIG. 10, the deposited toner image is subsequently transferred to a receiving member 45, such as paper, by applying an electrostatic charge to the rear surface of the receiving member by means of a charging means 47 such as a corona device. The transferred toner image is thereafter fused to the receiving member by conventional means (not shown) such as an oven fuser, a hot roll fuser, a cold pressure fuser, or the like.

The deposited toner image can be transferred to a receiving member such as paper or transparency material by any suitable technique conventionally used in electrophotography, such as corona transfer, pressure transfer, adhesive transfer, bias roll transfer, and the like. Typical corona transfer entails contacting the deposited toner particles with a sheet of paper and applying an electrostatic charge on the side of the sheet opposite to the toner particles. A single wire corotron having applied thereto a potential of between about 5,000 and about 8,000 volts provides satisfactory transfer.

After transfer, the transferred toner image can be fixed to the receiving sheet. The fixing step can be also identical to that conventionally used in electrophotographic imaging. Typical, well known electrophotographic fusing techniques include heated roll fusing, flash fusing, oven fusing, laminating, adhesive spray fixing, and the like.

After the toned image is transferred, the xeroprinting master can be cleaned, if desired, to remove any residual toner and then erased by an AC corotron, or by any other suitable means. The developing, transfer, fusing, cleaning and erasure steps can be identical to that conventionally used in xerographic imaging. However, if desired, the master can be erased by conventional AC corona erasing techniques, which entail exposing the imaging surface to AC corona discharge to neutralize any residual charge on the master. Typical potentials applied to the corona wire of an AC corona erasing device range from about 3 kilovolts to about 10 kilovolts.

If desired, the imaging surface of the xeroprinting master can be cleaned. Any suitable cleaning step that is conventionally used in electrophotographic imaging can be employed for cleaning the xeroprinting master of this invention. Typical well known electrophotographic cleaning techniques include brush cleaning, blade cleaning, web cleaning, and the like.

After transfer of the deposited toner image from the master to a receiving member, the master can be cycled through additional steps as shown in FIGS. 5 to 10 to prepare additional imaged receiving members.

The process of the present invention combines the advantages of a master-based printing system for printing the fixed data high resolution images and the advantages of a photoreceptor-based printing system to print the lower resolution variable data. Since the fixed data high resolution images need to be written only once to yield a printing master, simultaneous printing of fixed data and variable data can be achieved at high speed, high resolution and lower cost. Unlike conventional laser xerography in which both fixed data and variable are digitized and written once for each print, thus requiring massive memory and very high data transfer rates (and hence being much more costly) to achieve high printing speed, the process of the present invention achieves high printing speed, high resolution and lower cost.

Unlike some prior art techniques in which the high resolution fixed data are pre-printed using an offset plate and the offset printing process and the variable data are then printed using a photoreceptor and the xerographic progress in a laser printer, the process of present invention utilizes the same imaging member and printing engine to print the fixed and variable data. Accurate registration thus can be much more easily maintained.

Compared with the xeromaster of U.S. Pat. No. 4,835,570 (Robson) which requires solvent vapor treatment to prepare the master, the xeroprinting master of the present invention is prepared via heat development only, which eliminates the need for organic solvents or vapors and is thus desirable for safety, environmental reasons, aesthetics, cost benefits, simplicity, and convenience. A further advantage of the present invention is that the contrast voltage or contrast potential of the fixed data areas on the xeroprinting master and the contrast voltage or contrast potential of the variable data areas on the xeroprinting master of the present invention are substantially similar in magnitude to each other and exhibit a substantially higher contrast voltage efficency. Thus, a high degree of image uniformity can be achieved with respect to the fixed data and the variable data. Generally it is preferred that the difference in contrast voltage between the fixed and variable data is less than about 20 to 100 volts. Additionally, the contrast voltages for the fixed data and variable data image of the present invention can exhibit a contrast voltage efficiency greater than about 90 percent compared with a value of less than about 60 percent for the prior art xeromaster which is prepared by solvent treatment. Thus, when the final composite latent image comprising both the fixed data areas and the variable data areas is developed, the toner particles develop both areas uniformly to result in a high quality image.

Specific embodiments of the invention will now be described in detail. These examples are intended to be illustrative, and the invention is not limited to the materials, conditions, or process parameters set forth in these embodiments. All parts and percentages are by weight unless otherwise indicated.

EXAMPLE I

Master-making

A xeroprinting master precursor member was prepared by dissolving about 16.8 grams of a terpolymer of styrene/ethylacrylate/acrylic acid (obtained from Desoto Company as E-335) and about 3.2 grams of N,N'-diphenyl-N,N'-bis(3''-methylphenyl)-(1,1'-biphenyl)-4,4'-diamine in about 80.0 grams of toluene. The N,N'-diphenyl-N,N'-bis(3''-methylphenyl)-(1,1'-biphenyl)-4,4'-diamine is a charge transport material capable of transporting positive charges (holes). N,N'-diphenyl-N,N'-bis(3''-methylphenyl)-(1,1'-biphenyl)-4,4'-diamine was prepared as described in U.S. Pat. No. 4,265,990, the disclosure of which is totally incorporated herein by reference. The resulting solution was coated by solvent extrusion techniques onto a 12 inch wide 100 micron (4 mil) thick Mylar® polyester film (available from E. I. Du Pont de Nemours & Company) having a thin, semi-transparent aluminum coating. The deposited softenable layer was allowed to dry at about 115° C. for about 2 minutes. The thickness of the dried softenable layer was about 6 microns. The temperature of the softenable layer was then raised to about 115° C. to lower the viscosity of the exposed surface of the softenable layer to about $5\times10^3$ poises in preparation for the deposition of marking material. A thin layer of particulate vitreous selenium was then applied by vacuum deposition in a vacuum chamber maintained at a vacuum of about $4\times10^{-4}$ Torr. The imaging member was then rapidly chilled to room temperature. A reddish monolayer of selenium particles having an average diameter of about 0.3 micron embedded about 0.05 to 0.1 micron below the exposed surface of the copolymer was formed.

The resulting xeroprinting master precursor member was then uniformly negatively charged to a surface potential of about −600 volts with a corona charging device and was subsequently exposed by placing a test pattern mask comprising a silver halide image in contact with the imaging member and exposing the member to light through the mask. The exposed member was thereafter developed by subjecting it to a temperature of about 115° C. for about 5 seconds using a hot plate in contact with the polyester. The resulting xeroprinting master exhibited excellent image quality, resolution in excess of 228 line pairs per millimeter, and an optical contrast density of about 1.2. The optical density of the $D_{max}$ area was about 1.8 and that of the $D_{min}$ area was about 0.60. The $D_{min}$ was due to substantial depthwise migration of the selenium particles toward the aluminum layer in the $D_{min}$ regions of the image.

EXAMPLE II

Figure 11:
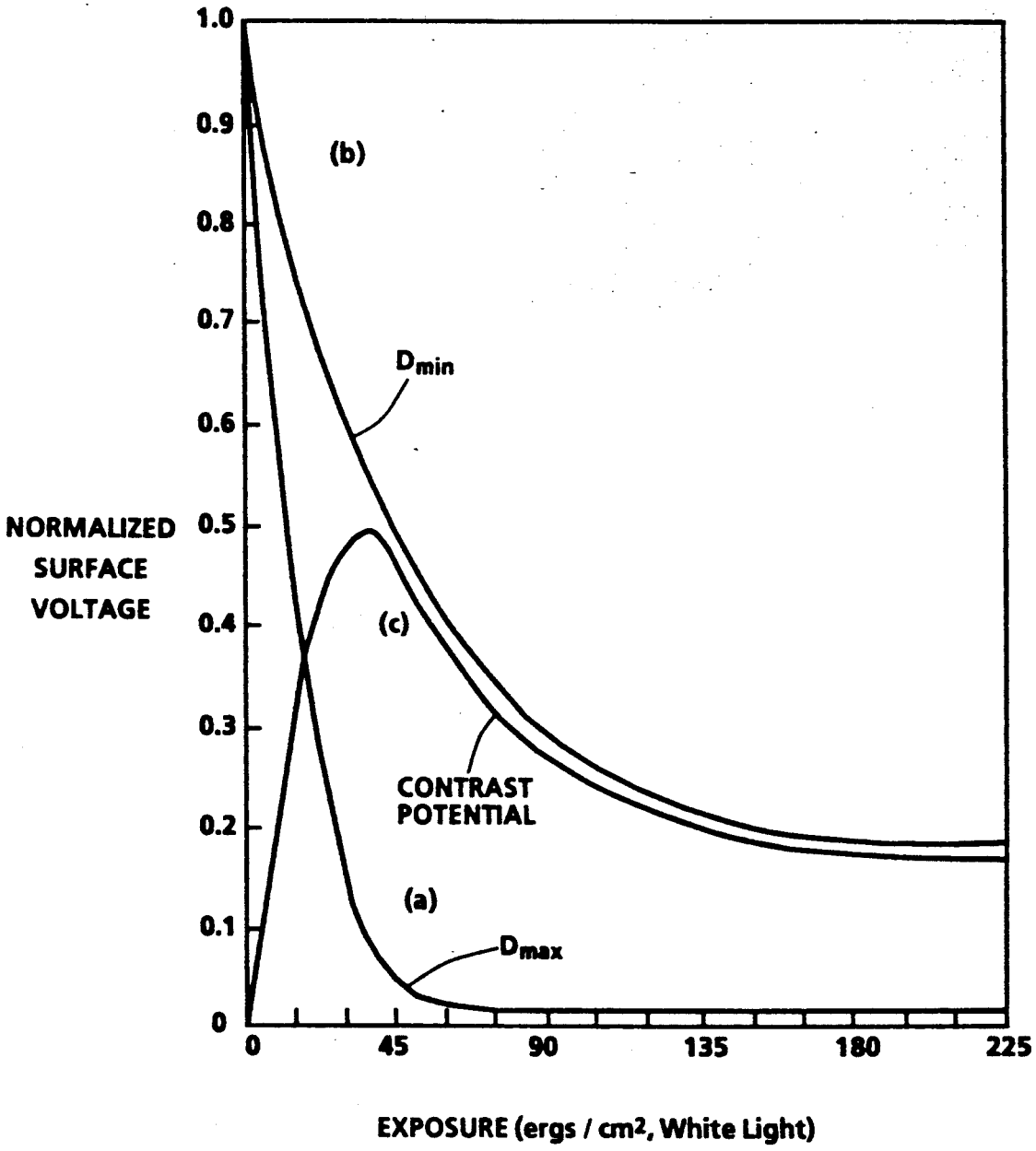
FIG. 11 illustrates schematically the photodischarge characteristics of the $D_{max}$ and $D_{min}$ areas and the resulting electrostatic contrast voltage efficiency of a xeroprinting master prepared according to the present invention which is uniformly charged to a polarity the same as the polarity that the charge transport material in the softenable layer is capable of transporting and then uniformly exposed to activating radiation.

(Photodischarge Characteristics, Positive Charging, as Illustrated in FIG. 11)

Three xeroprinting masters prepared as described in Example I were uniformly positively charged and then flood exposed to light at varying illumination intensities as follows.

A first xeroprinting master prepared as described in Example I was uniformly positively charged with a corona charging device to a potential of about +600 volts, followed by a brief uniform flash exposure to 400 to 700 nanometer activating illumination of about 40 ergs/cm$^2$. The surface potential was about +60 volts in the $D_{max}$ (unmigrated) region of the image and about +330 volts in the $D_{min}$ (migrated) region, thereby yielding an electrostatic contrast voltage of about +270 volts and a contrast voltage efficiency of about 45 percent of the initially applied voltage. The surface potentials of the $D_{max}$ areas and $D_{min}$ areas of the master were monitored with electrostatic voltmeters.

A second xeroprinting master prepared as described in Example I was uniformly positively charged with a corona charging device to a potential of about +600 volts, followed by a brief uniform flash exposure to 400 to 700 nanometer activating illumination of about 20 ergs/cm$^2$. The surface potential was about +180 volts in the $D_{max}$ (unmigrated) region of the image and about +372 volts in the $D_{min}$ (migrated) region, thereby yielding an electrostatic contrast voltage of about +192 volts and a contrast voltage efficiency of about 32 percent of the initially applied voltage. The surface potentials of the $D_{max}$ areas and $D_{min}$ areas of the master were monitored with electrostatic voltmeters.

A third xeroprinting master prepared as described in Example I was uniformly positively charged with a corona charging device to a potential of about +600 volts, followed by a brief uniform flash exposure to 400 to 700 nanometer activating illumination of about 80 ergs/cm$^2$. The surface potential was about +12 volts in the $D_{max}$ (unmigrated) region of the image and about +180 volts in the $D_{min}$ (migrated) region, thereby yielding an electrostatic contrast voltage of about +168 volts and a contrast voltage efficiency of about 28 percent of the initially applied voltage. The surface potentials of the $D_{max}$ areas and $D_{min}$ areas of the master were monitored with electrostatic voltmeters.

These three processes illustrate the illumination at varying intensities for flood exposure of the xeroprinting master that is charged to a polarity the same as that of which the charge transport material is capable of transporting. As can be seen from these results, when the master is charged to the same polarity as that of the charge of which the charge transport material is capable of transporting, varying the illumination intensity over a relatively narrow range of 20 to 80 ergs per square centimeter results in fluctuation of the contrast voltage efficiency of from 28 percent to 45 percent, with the maximum efficiency being near the middle of the range (40 ergs per square centimeter). In addition, the contrast potential efficiencies obtained for these processes are significantly lower than those obtained when the same xeromaster is uniformly charged negatively as illustrated in Example III, wherein contrast potentials of over 90 percent were obtained over a wide range of illumination intensities. These results illustrate the imaging member as it is charged as shown in FIG. 6.

Illustrated in FIG. 11 is a line graph representing the photodischarged surface voltage (normalized to its initial surface potential by dividing the photodischarged surface voltage of the $D_{min}$ and $D_{max}$ areas by the initial surface potential) as a function of the flood exposure energy in ergs per square centimeter for a xeroprinting master of Example I when the xeroprinting master is charged to a polarity the same as the polarity of the type of charge of which the charge transport material is capable of transporting (+600 volts). In FIG. 11, curve (a) represents the photodischarge characteristics for the $D_{max}$ areas of the master and curve (b) represents the photodischarge characteristics for the $D_{min}$ areas of the master. The contrast voltage efficiency, represented by curve (c), is given by the difference between curve (a) and curve (b). The contrast voltage of the electrostatic image is the difference between the photodischarged voltage of the $D_{max}$ areas and the photodischarged voltage of the $D_{min}$ areas. As can be seen from this graph, as the flood exposure energy increases, the contrast voltage efficiency initially increases, reaches a maximum of about 45 to 50 percent, and then decreases in this situation.

Figure 12:
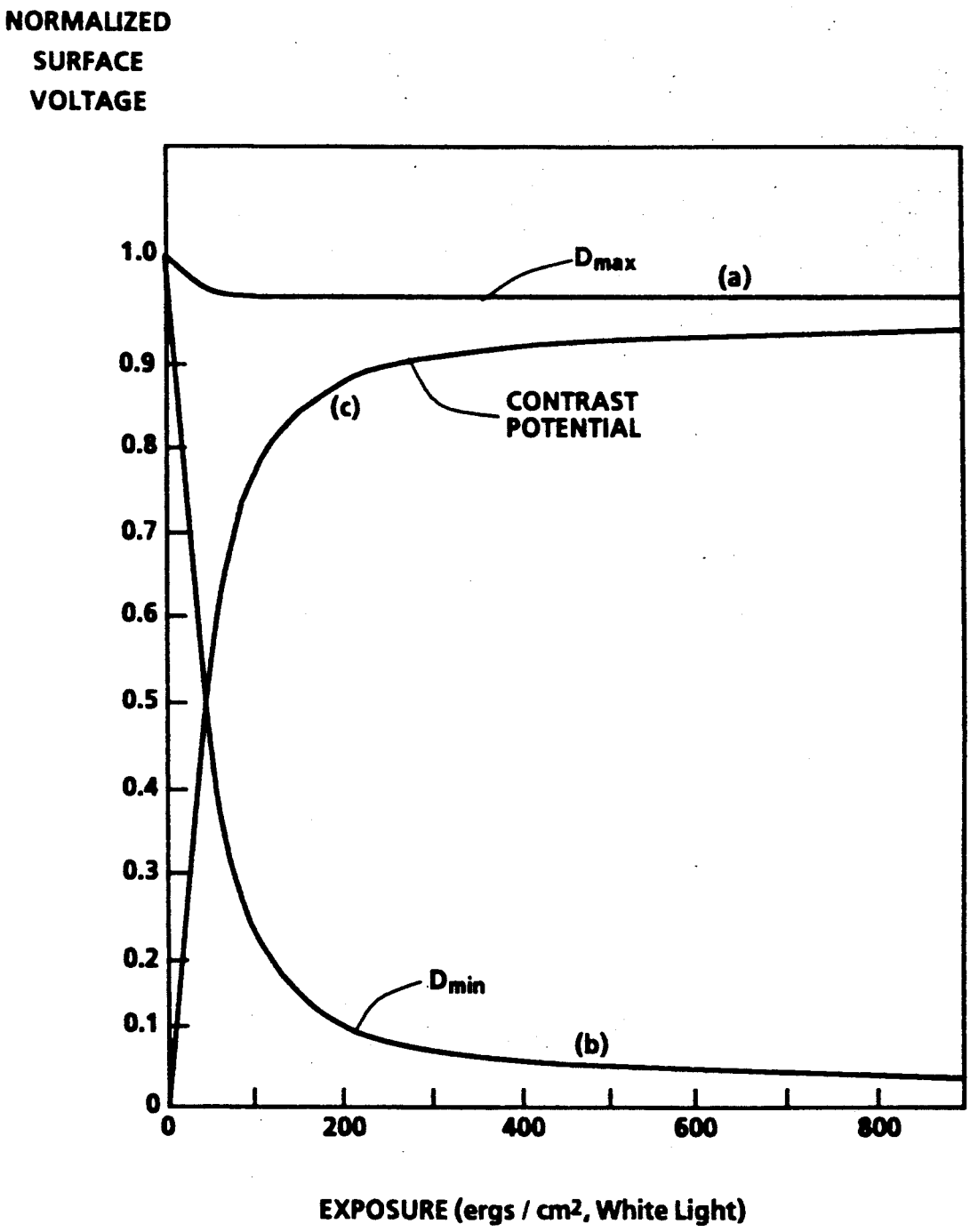
FIG. 12 illustrates schematically the photodischarge characteristics of the $D_{max}$ and $D_{min}$ areas and the resulting electrostatic contrast voltage efficiency of a xeroprinting master prepared according to the present invention which is uniformly charged to a polarity opposite to the polarity that the charge transport material in the softenable layer is capable of transporting and then uniformly exposed to activating radiation.

EXAMPLE III (Photodischarge Characteristics, Negative Charging, as Illustrated in FIG. 12)

Three xeroprinting masters prepared as described in Example I were uniformly negatively charged and then flood exposed to light at varying illumination intensities as follows.

A first xeroprinting master prepared as described in Example I was uniformly negatively charged with a corona charging device to about −600 volts, followed by a brief uniform flash exposure to 400 to 700 nanometer activating illumination of about 400 ergs/cm$^2$. The surface potential was about −575 volts in the $D_{max}$ (unmigrated) region of the image and about −30 volts in the $D_{min}$ (migrated) region, thereby yielding an electrostatic contrast voltage of about −545 volts and a contrast voltage efficiency of over 90 percent of the initially applied voltage. The surface potentials of the $D_{max}$ areas and $D_{min}$ areas of the master were monitored with electrostatic voltmeters.

A second xeroprinting master prepared as described in Example I was uniformly negatively charged with a corona charging device to about −600 volts, followed by a brief uniform flash exposure to 400 to 700 nanometer activating illumination of about 800 ergs/cm$^2$. The surface potential was about −576 volts in the $D_{max}$ (unmigrated) region of the image and about −18 volts in the $D_{min}$ (migrated) region, thereby yielding an electrostatic contrast voltage of about −558 volts and a contrast voltage efficiency of about 93 percent of the initially applied voltage. The surface potentials of the $D_{max}$ areas and $D_{min}$ areas of the master were monitored with electrostatic voltmeters.

A third xeroprinting master prepared as described in Example I was uniformly negatively charged with a corona charging device to about −600 volts followed by a brief uniform flash exposure to 400–700 nanometer activating illumination of about 3000 ergs/cm$^2$. The surface potential was about −575 volts in the $D_{max}$ (unmigrated) region of the image and about −7 volts in the $D_{min}$ (migrated) region, thereby yielding an electrostatic contrast voltage of about −568 volts and a contrast voltage efficiency of over 94 percent of the initially applied voltage. The surface potentials of the $D_{max}$ areas and $D_{min}$ areas of the master were monitored with electrostatic voltmeters.

These three processes illustrate the wide range of illumination intensities that can be employed for flood exposure of the xeroprinting master that is charged to a polarity opposite to that of which the charge transport material is capable of transporting without degrading contrast potential. In addition, the contrast voltage efficiencies obtained greatly exceed those obtained when the master is charged to a polarity the same as that of which the charge transport material is capable of transporting, as can be seen by comparing these results with those of Example II. These results illustrate the imaging member as it is charged as shown in FIG. 8.

Illustrated in FIG. 12 is a line graph representing the photodischarged surface voltage (normalized to its initial surface potential by dividing the photodischarged surface voltage of the $D_{min}$ and $D_{max}$ areas by the initial surface potential) as a function of the flood exposure energy in ergs per square centimeter for the xeroprinting master of Example I when the xeroprinting master is charged to the same initial surface voltage but to a polarity opposite to the polarity of the type of charge of which the charge transport material is capable of transporting (−600 volts). In FIG. 12, curve (a) represents the photodischarge characteristics for the $D_{max}$ areas of the master and curve (b) represents the photodischarge characteristics for the $D_{min}$ areas of the master. The contrast voltage efficency, represented by curve (c), is given by the difference between curve (a) and curve (b). Compared with FIG. 11, it can be seen that when the xeroprinting master is uniformly charged to a polarity opposite to the polarity of the type of charge of which the charge transport material is capable of transporting, contrast voltage efficiency in excess of 90 percent of the initial surface voltage is achieved. Furthermore, much broader process latitude for the flood exposure step is obtained while maintaining optimal contrast voltage.

The photodischarge characteristics, as illustrated in FIGS. 11 and 12, of the xeroprinting master prepared in accordance with the present invention are utilized to enable the process of the present invention as illustrated in Example IV.

EXAMPLE IV (Simultaneous Printing of Fixed Data and Variable Data, According to the Present Invention)

A xeroprinting master comprising a migration image (fixed data) was prepared as described in Example I.

To write the variable data in the non-migrated $D_{max}$ areas of the master, the master was uniformly positively charged with a corona charging device to about +600 volts and then imagewise exposed by contact-exposure through an optically positive silver-halide image (i.e. variable data) using 400 to 700 nanometer activating illumination of about 40 ergs/cm$^2$. In the non-migrated region ($D_{max}$) of the master, the surface voltage in the unexposed areas was +595 volts whereas the surface voltage in the exposed areas was +40 volts. In the migrated region ($D_{min}$) of the master, the surface voltage was +310 volts after exposure. Thus, relative to the background voltage of +40 volts, the contrast voltage for the fixed data image was +270 volts and the contrast voltage for the variable data image was +555 volts. The surface voltages were monitored with electrostatic voltmeters.

The xeromaster was then uniformly negatively corona-charged to yield a surface voltage of about −5 volts in the non-migrated unexposed areas corresponding to the variable data image. It was found that after this recharging step, the surface voltage in the non-migrated exposed areas corresponding to the background areas was about −600 volts and the surface voltage in the migrated exposed areas corresponding to the fixed data image was about −330 volts. The xeromaster was then flood exposed to 400 to 700 nanometer activating illumination of about 800 ergs/cm$^2$. It was found that after this flood exposure step, the surface voltage in the non-migrated areas corresponding to the background areas was about −570 volts; the surface voltage in the migrated areas corresponding to the fixed data image photodischarged almost completely to about −9 volts; the surface voltage in the non-migrated areas corresponding to the variable data image was −5 volts. Relative to the background voltage of −570 volts, the contrast voltage obtained for the fixed data image was 561 volts (voltage contrast efficiency of 93 percent) and the contrast voltage obtained for the variable data image was 565 volts (voltage contrast efficiency of 94 percent). Thus the contrast voltages obtained for the fixed data image and for the variable data image were substantially the same in magnitude.

The resulting electrostatic latent image was then toned with negatively charged toner particles comprising carbon black pigmented styrene/butadiene resin having an average particle size of about 10 micrometers to form a deposited toner image. The deposited toner image was electrostatically transferred to a sheet of paper by corona charging the rear surface of the paper and the transferred toner image thereafter heat fused to yield a high quality print. The transferred print exhibited a print density of about 1.2 in the fixed data areas and about 1.2 in the variable data areas.

EXAMPLE V (COMPARATIVE)

(Master-making, Process of U.S. Pat. No. 4,835,570)

A xeroprinting master precursor member was prepared by dissolving about 16.8 grams of a terpolymer of styrene/ethylacrylate/acrylic acid (obtained from Desoto Company as E-335) and about 3.2 grams of N,N'-diphenyl-N,N'-bis(3''-methylphenyl)-(1,1'-biphenyl)-4,4'-diamine in about 80.0 grams of toluene. The N,N'-diphenyl-N,N'-bis(3''-methylphenyl)-(1,1'-biphenyl)-4,4'-diamine is a charge transport material capable of transporting positive charges (holes). N,N'-diphenyl-N,N'-bis(3''-methylphenyl)-(1,1'-biphenyl)-4,4'-diamine was prepared as described in U.S. Pat. No. 4,265,990. The resulting solution was coated by solvent extrusion techniques onto a 12 inch wide 100 micron (4 mil) thick Mylar® polyester film (available from E.I. Du Pont de Nemours & Company) having a thin, semi-transparent aluminum coating. The deposited softenable layer was allowed to dry at about 115° C. for about 2 minutes. The thickness of the dried softenable layer was about 6 microns. The temperature of the softenable layer was then raised to about 115° C. to lower the viscosity of the exposed surface of the softenable layer to about $5\times10^3$ poises in preparation for the deposition of marking material. A thin layer of particulate vitreous selenium was then applied by vacuum deposition in a vacuum chamber maintained at a vacuum of about $4\times10^{-4}$ Torr. The imaging member was then rapidly chilled to room temperature. A reddish monolayer of selenium particles having an average diameter of about 0.3 micron embedded about 0.05to 0.1 micron below the exposed surface of the copolymer was formed.

A xeroprinting master was prepared from the xeroprinting master precursor member using solvent treatment in accordance with the teaching of U.S. Pat. No. 4,835,570, the disclosure of which is totally incorporated herein by reference, as follows. The xeroprinting master precursor member was uniformly positively charged to a surface potential of about +600 volts with a corona charging device and was subsequently exposed by placing a test pattern mask comprising a silver halide image in contact with the imaging member and exposing the member to light through the mask. The exposed member was thereafter developed by a combination of vapor and heat treatment comprising exposure to methyl ethyl ketone in a vapor chamber for about 35 seconds and then heating to about 115° C. for about 5 seconds using a hot plate in contact with the polyester. The resulting xeroprinting master exhibited excellent image quality, resolution in excess of 228 line pairs per millimeter, and an optical contrast density of about 0.67. The optical density of the $D_{max}$ area was about 0.95 and that of the $D_{min}$ area was about 0.28. The very low $D_{min}$ was due to agglomeration and coalescence of the selenium particles into fewer and larger particles in the $D_{min}$ regions of the image.

Figure 13:
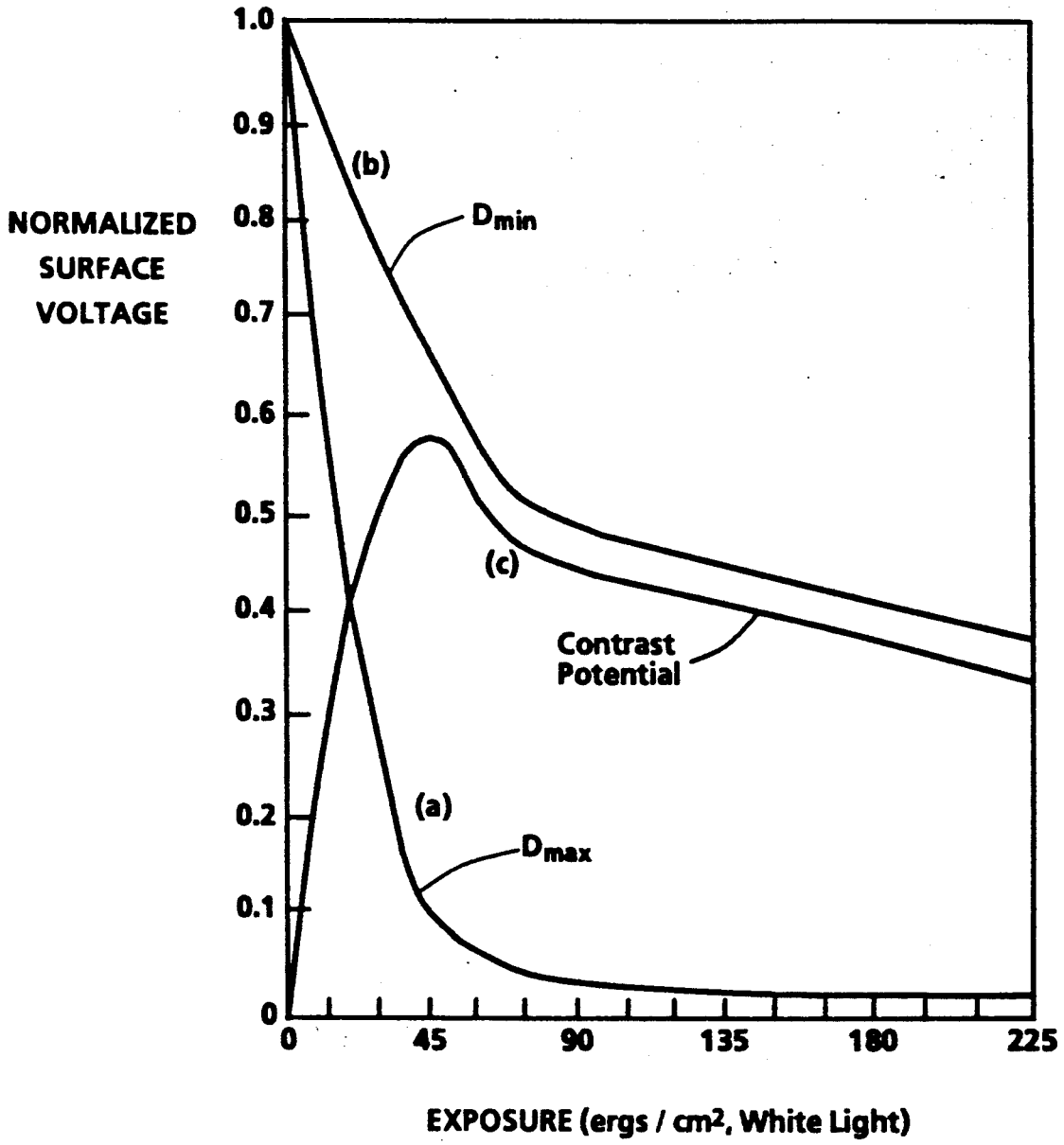
FIG. 13 illustrates schematically the photodischarge characteristics of the $D_{max}$ and $D_{min}$ areas and the resulting electrostatic contrast voltage efficiency of a xeroprinting master prepared according to U.S. Pat. No. 4,835,570 which is uniformly charged to a polarity the same as the polarity that the charge transport material in the softenable layer is capable of transporting and then uniformly exposed to activating radiation.

Illustrated in FIG. 13 is a line graph representing the photodischarged surface voltage (normalized to its initial surface potential by dividing the photodischarged surface voltage of the $D_{min}$ and $D_{max}$ areas by the initial surface potential) as a function of the flood exposure energy in ergs per square centimeter for the xeromaster prepared as described above when the xeroprinting master is charged to a polarity the same as the polarity of the type of charge of which the charge transport material is capable of transporting (+600 volts). In FIG. 13, curve (a) represents the photodischarge characteristics for the non-agglomerated $D_{max}$ areas of the master and curve (b) represents the photodischarge characteristics for the agglomerated $D_{min}$ areas of the master. The contrast voltage efficency, represented by curve (c), is given by the difference between curve (a) and curve (b). The contrast voltage of the electrostatic image is the difference between the photodischarged voltage of the $D_{max}$ areas and the photodischarged voltage of the $D_{min}$ areas. As can be seen from this graph, as the flood exposure energy increases, the contrast voltage efficiency initially increases, reaches a maximum of about 60 percent, and then decreases in this situation.

When the xeroprinting master was charged to the same initial surface voltage but to a polarity opposite to the polarity of the type of charge of which the charge transport material is capable of transporting (−600 volts), no photodischarge was observed in the $D_{max}$ and $D_{min}$ areas of the master over the same range of flood exposure energies (0 to 800 ergs/cm$^2$) used in FIG. 12. It is believed that particle to particle hopping charge transport is not possible in this situation because the agglomerated and coalesced selenium particles, which produce the image on the master, remain substantially close to the surface of the softenable layer instead of being dispersed throughout the softenable layer.

EXAMPLE VI (COMPARATIVE)

(Printing of Fixed Data and Variable Data, Process of U.S. Pat. No. 4,835,570)

A xeroprinting master comprising an agglomeration image (fixed data) was prepared as described in Example V. Using this master, the variable data was written in the non-agglomerated $D_{max}$ areas of the master in accordance with the teaching of U.S. Pat. No. 4,835,570 as follows. The master was uniformly positively charged with a corona charging device to about +600 volts and then imagewise exposed by contact-exposure through a silver-halide image (i.e. variable data) using 400 to 700 nanometer activating illumination of about 40 ergs/cm$^2$. In the non-agglomerated region ($D_{max}$) of the master, the surface voltage in the unexposed areas was +595 volts whereas the surface voltage in the exposed areas was +70 volts. In the agglomerated region ($D_{min}$) of the master, the surface voltage was +430 volts after exposure. Thus, relative to the background voltage of +70 volts, the contrast voltage for the fixed data image was +360 volts and the contrast voltage for the variable data image was +525 volts. The surface voltages were monitored with electrostatic voltmeters. The greatly different contrast voltages for the fixed data and variable data produced non-uniform xerographic development and printing.

EXAMPLE VII (Printing of Fixed Data and Variable Data, Liquid Toner)

A composite electrostatic latent image comprising the fixed data image and the variable data image was produced on a xeroprinting master as described in Example IV. The latent image was developed with a liquid developer to form a deposited toner image. The liquid developer contained about 2 percent by weight of carbon black pigmented polyethylene acrylic acid resin and about 98 percent by weight of Isopar ® L (isoparaffinic hydrocarbon). The deposited toner image was transferred and fused to a sheet of paper to yield a very high quality xeroprint.

EXAMPLE VIII (Printing of Fixed Data and Variable Data)

Additional xeroprinting master precursor members were prepared by dissolving about 15.2 grams of an 80/20 mole percent copolymer of styrene and co-n-hexylmethacrylate and about 4.8 grams of N,N'-diphenyl-N,N'-bis(3''-methylphenyl)-(1,1'-biphenyl)-4,4'-diamine in about 80 grams of toluene. The resulting solution was coated by solvent extrusion techniques onto a 12 inch wide 100 micron (4 mil) thick Mylar ® polyester film (available from E.I. Du Pont de Nemours & Company) having a thin, semi-transparent aluminum coating. The deposited softenable layer was allowed to dry at about 115° C. for about 2 minutes. The thickness of the dried softenable layer was about 9 microns. The temperature of the softenable layer was then raised to about 115° C. to lower the viscosity of the exposed surface of the softenable layer to about $5\times10^3$ poises in preparation for the deposition of marking material. A thin layer of particulate vitreous selenium was then applied by vacuum deposition in a vacuum chamber maintained at a vacuum of about $4\times10^{-4}$ Torr. The imaging member was then rapidly chilled to room temperature. A reddish monolayer of selenium particles having an average diameter of about 0.35 micron embedded about 0.05 to 0.1 micron below the exposed surface of the copolymer was formed.

The resulting xeroprinting master precursor member was then uniformly negatively charged to a surface potential of about −900 volts with a corona charging device and was subsequently exposed by placing a test pattern mask in contact with the imaging member and exposing the member to light through the mask. The exposed member was thereafter developed by subjecting it to a temperature of about 115° C. for about 5 seconds using a hot plate in contact with the polyester. The resulting xeroprinting master comprising a migration image (fixed data image) exhibited excellent image quality, resolution in excess of 228 line pairs per millimeter, and an optical contrast density of about 1.2. Optical density of the $D_{max}$ area was about 1.8 and that of the $D_{min}$ area was about 0.60. The $D_{min}$ was due to substantial depthwise migration of the selenium particles toward the aluminum layer in the $D_{min}$ regions of the image.

To write the variable data in the non-migrated $D_{max}$ areas of the master, the master was uniformly positively charged with a corona charging device to about +800 volts and then imagewise exposed by contact-exposure through an optically positive silver-halide image (i.e. variable data) using 400 to 700 nanometer activating illumination about 40 ergs/cm$^2$. In the non-migrated region ($D_{max}$) of the master, the surface voltage in the unexposed areas was +790 volts whereas the surface voltage in the exposed areas was +80 volts. In the migrated region ($D_{min}$) of the master, the surface voltage was +480 volts after exposure. Thus, relative to the background voltage of 80 volts, the contrast voltage for the fixed data image was 400 volts and the contrast voltage for the variable data image was 710 volts. The surface voltages were monitored with electrostatic voltmeters.

The xeromaster was then uniformly negatively corona-charged to yield a surface voltage of about −20 volts in the non-migrated unexposed areas corresponding to the variable data image. It was found that after this recharging step, the surface voltage in the non-migrated exposed areas corresponding to the background areas was about −730 volts and the surface voltage in the migrated exposed areas corresponding to the fixed data image was about −420 volts. The xeromaster was then flood exposed to 400 to 700 nanometer activating illumination of about 800 ergs/cm$^2$. It was found that after this flood exposure step, the surface voltage in the non-migrated areas corresponding to the background areas was about −720 volts; the surface voltage in the migrated areas corresponding to the fixed data image photodischarged almost completely to about −15 volts; the surface voltage in the non-migrated areas corresponding to the variable data image was −20 volts. Relative to the background voltage of −720 volts, the contrast voltage obtained for the fixed data image was 705 volts and the contrast voltage obtained for the variable data image was 700 volts. Thus the contrast voltages obtained for the fixed data image and for the variable data image were substantially the same in magnitude. The resulting electrostatic latent image was then toned with negatively charged toner particles. The deposited toner image was transferred and fused to a sheet of paper to yield a uniform high quality print.

EXAMPLE IX (Softenable Layer Contains Electron Transport Material)

A xeroprinting master precursor member is prepared by dissolving about 16.8 grams of a terpolymer of styrene/ethylacrylate/acrylic acid (available from Desoto Company as E-335), and about 3.2 grams of (4-phenethoxycarbonyl-9-fluorenylidene)malonontrile in about 80.0 grams of toluene. The (4-phenethoxycarbonyl-9-fluorenylidene)malonontrile is a charge transport material capable of transporting negative charges (electrons) and is prepared according to the process described in U.S. Pat. No. 4,474,865, the disclosure of which is totally incorporated herein by reference. The resulting solution is coated by solvent extrusion techniques onto a 12 inch wide 100 micron (4 mil) thick Mylar ® polyester film (available from E.I. Du Pont de Nemours & Company) having a thin, semi-transparent aluminum coating. The deposited softenable layer is allowed to dry at about 115° C. for about 2 minutes. The thickness of the dried softenable layer is about 6 microns. The temperature of the softenable layer is then raised to about 115° C. to lower the viscosity of the exposed surface of the softenable layer to about $5\times10^3$ poises in preparation for the deposition of marking material. A thin layer of particulate vitreous selenium is then applied by vacuum deposition in a vacuum chamber maintained at a vacuum of about $4\times10^{-4}$ Torr. The imaging member is then rapidly chilled to room temperature. A reddish monolayer of selenium particles having an average diameter of about 0.3 micron embedded about 0.05 to 0.1 micron below the exposed surface of the copolymer is thus formed.

The resulting xeroprinting master precursor member is then uniformly negatively charged to a surface potential of about −600 volts with a corona charging device and is subsequently exposed by placing a test pattern mask comprising a silver halide image in contact with the imaging member and exposing the member to light through the mask. The exposed member is thereafter developed by subjecting it a temperature of about 115° C. for about 5 seconds using a hot plate in contact with the polyester. It is believed that the resulting xeroprinting master comprising a migration image (fixed data image) will exhibit excellent image quality, resolution, and optical contrast density.

The resulting master comprising a migration image (fixed data image) is then uniformly negatively charged with a corona charging device to about −600 volts and then imagewise exposed by contact-exposure through an optically positive silver-halide image (i.e. variable data) using 400 to 700 nanometer activating illumination of about 40 ergs/cm$^2$ to write the variable data in the non-migrated $D_{max}$ areas of the master. The xeromaster is then uniformly positively corona-charged so that the surface voltage in the non-migrated unexposed areas (variable data image) becomes slightly positive. After this recharging step, the xeromaster is flood exposed to 400 to 700 nanometer activating illumination of about 800 ergs/cm$^2$. It is believed that the resulting contrast voltages for the fixed data image and for the variable data image will be substantially the same in magnitude and that the contrast voltage efficiency will be in excess of 80 percent.

The resulting electrostatic latent image comprising the fixed data and variable data is then toned and the deposited toner image is transferred and fused to a sheet of paper. It is believed that a uniform high quality print will be obtained.

Other embodiments and modifications of the present invention may occur to those skilled in the art subsequent to a review of the information presented herein; these embodiments and modifications, as well as equivalents thereof, are also included within the scope of this invention.

What is claimed is:

1. An imaging process for simultaneous printing of fixed and variable data which comprises, in the order stated, (1) providing a migration imaging member comprising a substrate, a softenable layer comprising a softenable material and migration marking material contained at or near the surface of the softenable layer, and a charge transport material capable of transporting charges of one polarity; (2) uniformly charging the imaging member; (3) exposing the charged imaging member to activating radiation in an imagewise pattern corresponding to the fixed data, thereby forming an electrostatic latent image on the imaging member; (4) thereafter causing the softenable material to soften by the application of heat, thereby enabling the migration marking material exposed to radiation to migrate through the softenable material toward the substrate in an imagewise pattern corresponding to the fixed data; (5) uniformly charging the imaging member to the same polarity as the polarity of the charges that the charge transport material in the softenable layer is capable of transporting; (6) exposing the charged imaging member to activating radiation in an imagewise pattern corresponding to the variable data, thereby creating an electrostatic latent image on the imaging member corresponding to the variable data in areas of the imaging member wherein the migration marking material has not migrated; (7) uniformly charging the imaging member to the polarity opposite to the polarity of the charges that the charge transport material in the softenable layer is capable of transporting; (8) uniformly exposing the charged member to activating radiation, thereby forming an electrostatic latent image corresponding to both the fixed data and the variable data; (9) developing the electrostatic latent image; and (10) transferring the developed image to a receiver sheet.

2. A process according to claim 1 wherein the charge transport material is capable of transporting positive charges.

3. A process according to claim 2 wherein the charge transport material is selected from the group consisting of diamine hole transporting materials, pyrazoline hole transporting materials, hydrazone hole transporting materials, and mixtures thereof.

4. A process according to claim 1 wherein the charge transport material is capable of transporting negative charges.

5. A process according to claim 4 wherein the charge transport material is selected from the group consisting of 9-fluorenylidene methane derivative electron transporting materials; vinyl aromatic electron transporting materials; electron transporting polymers selected from the group consisting of polyesters, polysiloxanes, polyamides, polyurethanes, and epoxies and having aromatic or heterocyclic groups with more than one substituent selected from the group consisting of nitro, sulfonate, carboxyl, and cyano; and mixtures thereof.

6. A process according to claim 1 wherein the imaging member contains a charge transport layer situated between the substrate and the softenable layer.

7. A process according to claim 1 wherein the imaging member contains an overcoat layer and the softenable layer is situated between the overcoat layer and the substrate.

8. A process according to claim 1 wherein the imaging member contains an adhesive layer situated between the substrate and the softenable layer.

9. A process according to claim 1 wherein the imaging member contains a charge blocking layer situated between the substrate and the softenable layer.

10. A process according to claim 1 wherein the migration marking material is selected from the group consisting of selenium, alloys of selenium and tellurium, alloys of selenium and arsenic, alloys of selenium, tellurium, and arsenic, phthalocyanines, and mixtures thereof.

11. A process according to claim 1 wherein the latent image on the imaging member is developed with a liquid developer.

12. A process according to claim 1 wherein the latent image on the imaging member is developed with a dry developer.

13. A process according to claim 1 wherein the imaging member is uniformly charged to a voltage with a magnitude of from about 50 to about 1,200 volts.

14. A process according to claim 1 wherein, subsequent to step (8) and prior to step (9), the potential difference between the image areas of the imaging member and the nonimage areas of the imaging member is from about 50 to about 1200 volts.

15. A process according to claim 1 wherein, subsequent to step (8) and prior to step (9), the potential difference between the imaging areas of the imaging member and the nonimage areas of the imaging member is at least 200 volts.

16. A process according to claim 1 wherein, subsequent to step (8) and prior to step (9), the potential difference between the image areas of the imaging member and the nonimage areas of the imaging member is from about 20 to about 95 percent of the potential to which the master was charged in step (7).

17. A process according to claim 1 wherein the charge uniformly applied to the imaging member in step (7) is of substantially the same magnitude as or of greater magnitude than the charge uniformly applied to the imaging member in step (5).

18. A process according to claim 1 wherein subsequent to step (7) the areas of the imaging member wherein the migration marking material has not migrated and which have not been exposed to radiation in step (6) have a charge magnitude of no more than about 100 volts and a charge polarity opposite to the polarity of charge applied to the imaging member in step (5).

19. A process according to claim 1 wherein subsequent to step (7) the areas of the imaging member wherein the migration marking material has not migrated and which have not been exposed to radiation in step (6) have a charge magnitude of no more than about 50 volts and a charge polarity opposite to the polarity of charge applied to the imaging member in step (5).

20. A process according to claim 1 wherein subsequent to step (7) the areas of the imaging member wherein the migration marking material has not migrated and which have not been exposed to radiation in step (6) have a charge magnitude of no more than about 20 volts and a charge polarity opposite to the polarity of charge applied to the imaging member in step (5).

* * * * *